US007081578B2

(12) United States Patent
Hikawa et al.

(10) Patent No.: US 7,081,578 B2
(45) Date of Patent: Jul. 25, 2006

(54) MUSICAL PERFORMANCE INFORMATION COMPRESSION APPARATUS, AND MUSICAL PERFORMANCE INFORMATION DECODING APPARATUS

(75) Inventors: Kazuo Hikawa, Tokyo (JP); Kenichi Takahashi, Tokyo (JP)

(73) Assignee: Crimson Technology, Inc., Tokyo (JP)

( * ) Notice: Subject to any disclaimer, the term of this patent is extended or adjusted under 35 U.S.C. 154(b) by 49 days.

(21) Appl. No.: 10/991,306

(22) Filed: Nov. 17, 2004

(65) Prior Publication Data

US 2005/0066796 A1 Mar. 31, 2005

Related U.S. Application Data

(63) Continuation of application No. PCT/JP03/06070, filed on May 15, 2003.

(30) Foreign Application Priority Data

May 17, 2002 (JP) ..... 2002-143620

(51) Int. Cl.
*G10H 7/00* (2006.01)

(52) U.S. Cl. ..... 84/603; 84/600

(58) Field of Classification Search ..... 84/600, 84/601, 602, 603, 609–610, 615, 626, 633, 84/634, 649–650, 653, 662, 665, 666
See application file for complete search history.

(56) References Cited

U.S. PATENT DOCUMENTS

| | | | | |
|---|---|---|---|---|
| 5,869,782 | A | 2/1999 | Shishido et al. | |
| 6,916,978 | B1 * | 7/2005 | Georges | 84/609 |
| 6,946,595 | B1 * | 9/2005 | Tamura et al. | 84/629 |
| 6,977,335 | B1 * | 12/2005 | Georges et al. | 84/609 |

FOREIGN PATENT DOCUMENTS

| | | |
|---|---|---|
| JP | 8-152881 | 6/1996 |
| JP | 8-202358 | 8/1996 |
| JP | 9-153819 | 6/1997 |
| JP | 2002-91436 | 3/2002 |
| JP | 2002-91437 | 3/2002 |

* cited by examiner

*Primary Examiner*—Kimberly Lockett
(74) *Attorney, Agent, or Firm*—Michael Best & Friedrich LLP

(57) ABSTRACT

A musical performance information compression apparatus or the like of the present invention has a primary code production unit which separates SMF or the like into information of a relative time between events, information of a sounding start pitch, information of loudness, information of a sounding end pitch, and other information for each channel and which integrates each information regardless of the channel and which disposes the integrated information in independent regions to produce a primary code, and a secondary code production unit which compresses the information of each region of the primary code produced by this primary code production unit by an LZ coding method, a Huffman coding method and the like.

2 Claims, 28 Drawing Sheets

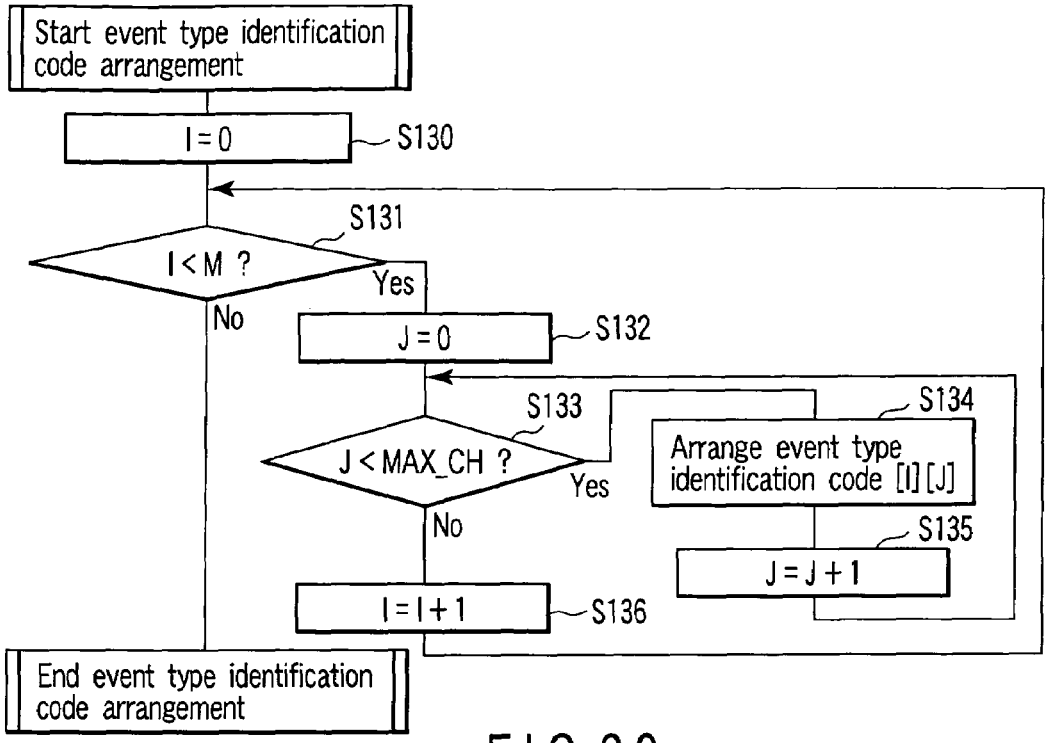

FIG.20

| Code (hexadecimal) | Event type |
|---|---|
| 0x00 | Polyphony after touch |
| 0x01 | Control change |
| 0x02 | Program change |
| 0x03 | Channel after touch |
| 0x04 | Pitch bend change |
| 0x05 | System exclusive |
| 0x06 | End of exclusive |
| 0x07 | Meta event |
| 0x08 | Expression (control change) |
| 0x09 | Date entry upper level (control change) |
| 0x0a | Modulation (control change) |
| 0x0b | Panpod (control change) |
| 0x0c | Hold pedal (control change) |
| 0x0d | NRPN lower level (control change) |
| 0x0e | NRPN upper level (control change) |
| 0x0f | Cutoff frequency (control change) |

FIG.21

| |
|---|
| Δtime code |
| NoteOn pitch code |
| NoteOff pitch code |
| Velocity value code |
| Difference bend value code |
| Difference expression value code |
| Event type identification code |
| Channel number code |
| Other information code |

FIG. 24

| |
|---|
| Track 0, Channel 0 |
| Track 0, Channel 1 |
| ⋮ |
| Track 0, Channel n |
| Track 1, Channel 0 |
| Track 1, Channel 1 |
| ⋮ |
| Track 1, Channel n |
| ⋮ |
| Track m, Channel 0 |
| Track m, Channel 1 |
| ⋮ |
| Track m, Channel n |

FIG. 25A

| |
|---|
| Track 0 |
| Track 1 |
| ⋮ |
| Track m |

FIG. 25B

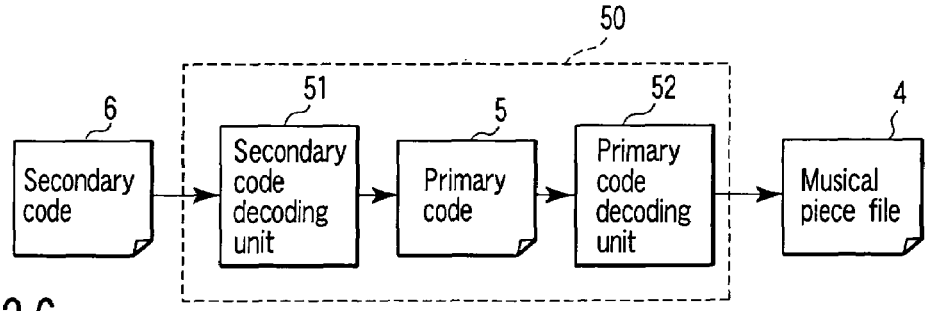

FIG. 26

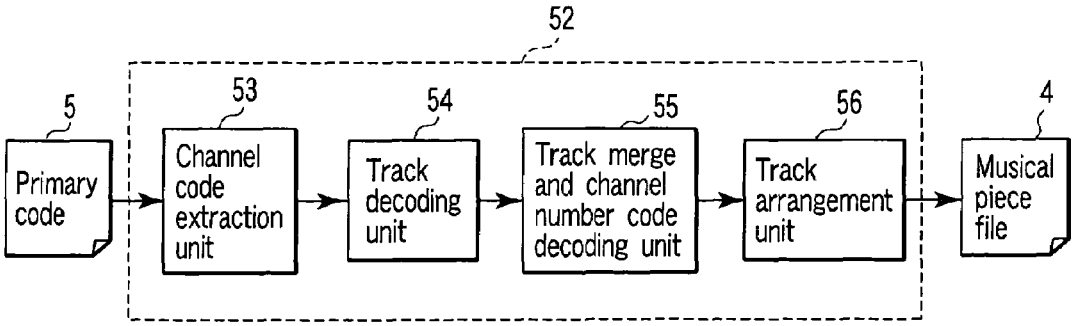

FIG. 27

| | SMF |
|---|---|
| Type 1 | Note On message |
| Type 2 | Note Off message |
| Type 3 | Other message |

FIG. 48

MUSICAL PERFORMANCE INFORMATION COMPRESSION APPARATUS, AND MUSICAL PERFORMANCE INFORMATION DECODING APPARATUS

CROSS-REFERENCE TO RELATED APPLICATIONS

This is a Continuation Application of PCT Application No. PCT/JP03/06070, filed May 15, 2003, which was published under PCT Article 21(2) in Japanese.

This application is based upon and claims the benefit of priority from prior Japanese Patent Application No. 2002-143620, filed May 17, 2002, the entire contents of which are incorporated herein by reference.

BACKGROUND OF THE INVENTION

1. Field of the Invention

The present invention relates to a technique to compress or decode, for example, musical performance information, particularly to a musical performance information compression apparatus for efficiently compressing a data amount of musical performance information, a musical performance information decoding apparatus, a musical performance information compression program product, and musical performance information decoding program product.

2. Description of the Related Art

In general, musical instrument digital interface (MIDI) standards have heretofore been known as standards concerning an interface for digital communication of musical performance information, for example, from musical instruments and the like. Moreover, in general, for example, a standard MIDI file (hereinafter referred to as SMF) has been known as a file to store data defined in the MIDI standards, and has already generally been used in various fields.

In this SMF, each musical performance information is represented by an MIDI message constituted by combination of several characters of one byte, a status of one byte of the MIDI message is defined by the MIDI standards, and the musical performance information is accordingly distinguished. Furthermore, status bytes are followed by data bytes, and the number of the data bytes differs with the type of the musical performance information.

It is to be noted that the status byte additionally includes the type of the status, and information of a channel number.

Therefore, today, considering from a comparatively large file size of the SMF, it has been demanded that a data amount of each musical performance information included in this SMF is efficiently compressed in a case where the SMF is applied to a system or the like for recording and transmitting a large number of musical data, and technical development has been advanced for the compression.

Here, as a reversible coding method which is a coding method for decoding coded information to completely match the information with original information, for example, a Lempel-Zif (LZ) coding method, a Huffman coding method, a run length coding method, and further a composite system (e.g., LHA, ZIP, etc.) of them have been generally known and used.

Among them, first, in the LZ system, repeated data is compressed utilizing repetition of data patterns. Therefore, when the number of the same data patterns appears in a predetermined range in input data, there is a characteristic that compression ratio drops. Here, compression ratio refers to a ratio of a size of compressed data to that of the data before compression. Moreover, when the compression ratio drops, it is meant that compression efficiency becomes higher (better).

Further in the Huffman coding system, a predetermined tree weighted by appearance frequency of codes of each byte is constituted regardless of the data pattern, the data is coded in such a manner that the data can be recorded concerning the code having more weight with a small number of bits, and therefore the system is effective for the data having bias in appearance frequency of the codes of each byte.

Moreover, the LHA coding system in which these LZ and Huffman coding systems are combined has advantages of the LZ and Huffman coding systems.

Here, in the SMF, each musical performance information is constituted of delta time (hereinafter referred to as Δtime) and event, and further each event includes information such as a note-on or note-off status, musical pitch, loudness and the like.

In general, the musical piece is frequently constituted of repetition of similar phrases, but a musical producer sometimes subtly changes, for example, sound loudness or length in order to prevent a musical piece from being monotonous. Even when phrases having the same pattern exist in different channels, but when the event of the musical performance information of the SMF includes information concerning a channel number, recording data has a different pattern.

In this manner, in the SMF, the data is compressed by a general-purpose compression system due to the above-described situations caused when a plurality of pieces of information are included in an event which is a minimum unit of data recording, and in this case the system is further devised in order to raise the compression efficiency.

In consideration of this respect, for example, in Jpn. Pat. Appln. KOKAI Publication No. 9-16168, techniques concerning a musical performance information compression apparatus and a musical performance information decoding apparatus have been described in which the musical performance information is separated into information of pitch, information of loudness, information of length, and other information by primary code production means, each information is disposed in an independent region, and accordingly the compression efficiency by the subsequent LZ system is raised.

However, in the technique described in the Jpn. Pat. Appln. KOKAI Publication No. 9-16168, although each musical performance information is dependent in time at a primary coding time, information on an order of each musical performance information is not stored, and therefore the order of each musical performance information sometimes changes in a case where the coded musical performance information is decoded. That is, the decoded musical performance information does not completely match the original musical performance information in some case.

BRIEF SUMMARY OF THE INVENTION

An object of the present invention is to restore an order of each musical performance information even after decoding, prevent a situation in which decoded musical performance information does not match original musical performance information from being caused, omit recording of a part of the musical performance information, and accordingly reduce a size of a primary code. A further object is to efficiently compress or expand a data amount of musical performance information by combination with a general-purpose compression system.

To achieve the objects, according to a first aspect of the present invention, there is provided a musical performance information compression apparatus which receives an input of a file including an event constituted of at least information of a sounding start pitch, information of loudness, information of a sounding end pitch, and other information, and information of a relative time between the events, and having track data attributed to a predetermined channel and which compresses the file, the apparatus comprising: primary code production section which separates track data of the file into a plurality of track data attributed to channels, holds information indicating attribution to the channel, further separates the track data attributed to each channel for each information, integrates the separated information by each type of the information regardless of the attribution to the channel, and disposes the information in an independent region for each type to produce a primary code; and secondary code production section which compresses each information disposed in each region of the primary code produced by the primary code production means by a predetermined compression method.

According to a second aspect, there is provided a musical performance information decoding apparatus which decodes a secondary code produced by compression of a file including an event constituted of at least information of a sounding start pitch, information of loudness, information of a sounding end pitch, and other information, and information of a relative time between the events, and having track data attributed to a predetermined channel into a primary code and which further decodes the primary code into the file, the apparatus comprising: secondary code decoding section which decodes the secondary code into the primary code; and primary code decoding section which extracts each information of each type disposed in an independent region with respect to the primary code, refers to information indicating attribution to the channel, constitutes each extracted information as a plurality of track data attributed to each channel, and further constitutes the information as track data of the file to decode the primary code into the file.

BRIEF DESCRIPTION OF THE SEVERAL VIEWS OF THE DRAWING

FIG. 20 is a flowchart showing a process relating to event type identification code arrangement executed in step S67 of FIG. 13 in further detail;

FIG. 21 is a diagram showing one example of an event type identification code table;

FIG. 24 is a diagram showing a basic arrangement order of a primary code 5 produced by the primary code production unit 2;

FIG. 25A is a diagram showing a detailed inner arrangement order of codes of the primary code 5 produced in the primary code production unit 2, and FIG. 25B is a diagram showing the inner arrangement order of channel number codes;

FIG. 26 is a block diagram showing a constitution of a musical performance information decoding apparatus 50 according to one embodiment of the present invention;

FIG. 27 is a block diagram showing a detailed constitution of a primary code decoding unit 52 in the musical performance information decoding apparatus 50 according to one embodiment;

FIG. 48 is a diagram showing a type correspondence table by musical performance information format.

DETAILED DESCRIPTION OF THE INVENTION

Figure 1:
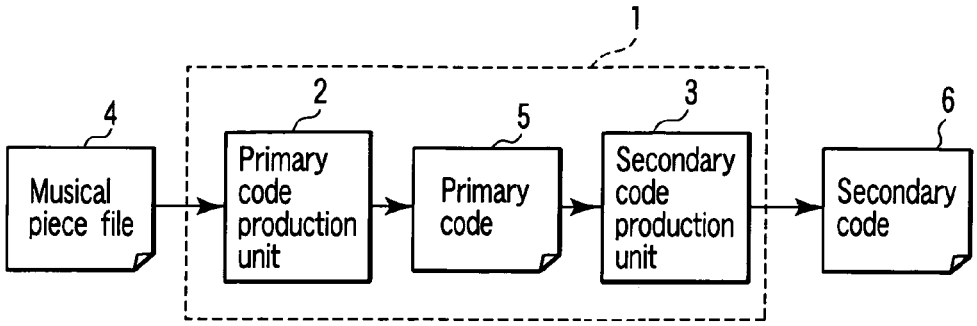
FIG. 1 is a block diagram showing a constitution of a musical performance information compression apparatus 1 according to one embodiment of the present invention.

Embodiments of the present invention will be described hereinafter with reference to the drawings.

First, a format of input data (musical piece file) which is assumed will be described in detail in a musical performance information compression apparatus, and a musical performance information decoding apparatus according to one embodiment. In a first embodiment, a format of SMF is assumed as a format of the musical piece file. This SMF is roughly classified into a header chunk and a track chunk, and in each header chunk, minimum information directly related to a whole MIDI file, for example, information of the number of track data or the like is included. Furthermore, MIDI data (track data) relating to 16 channels at maximum can be included in each track chunk. Moreover, each track data comprises two elements which are Δtime and event. In further detail, Δtime is stored in variable length notation, and indicates a time interval to the subsequent event. That is, when a first event of a certain track occurs simultaneously with start of the track, or two events occur in the same timing, Δtime is 0. Furthermore, the event includes various musical performance information such as a note-on or note-off status, pitch (note number), loudness (velocity) and the like. That is, this event is an MIDI channel message, and comprises a status byte and a data byte in detail. When preceding event and status are the same, status bytes are sometimes omitted. Additionally, the first event has to designate a status.

An outline of the format of SMF has been described above, and the format adopted by the musical performance information compression apparatus according to one embodiment is characterized in that identification information by an event type of an event having at least highest use frequency in events included in an event group recorded in the musical performance information file is included in a relative time code of the primary code and recorded. In further detail, the Δtime of the primary code is converted in such a manner that identification by event type is possible, and recorded. Accordingly, at the time of the coding of the event having the highest use frequency, and an event having the next highest use frequency, the coding of an event type identification code is omitted, and a data amount of the primary code is reduced. Needless to say, this is one of characteristic parts according to the first embodiment.

(Musical Performance Information Compression Apparatus, etc.)

Constitutions and functions of a musical performance information compression apparatus, a musical performance information compression method, and a musical performance information compression program according to one embodiment will be described hereinafter according to one embodiment, in which a primary code, and further secondary code are produced from a musical piece file, in detail with reference to FIGS. 1 to 25.

It is to be noted that the function of the musical performance information compression apparatus corresponds to a musical performance information compression method, and a musical performance information compression program according to one embodiment. The musical performance information compression program is executable by a general-purpose computer or the like.

First, the constitution of the musical performance information compression apparatus according to one embodiment of the present invention will be described with reference to FIG. 1. As shown in FIG. 1, a musical performance information compression apparatus 1 is constituted of a primary code production unit 2 and a secondary code production unit 3. It is to be noted that primary code production means described in the claims corresponds to the primary code production unit 2 or the like, and secondary code production means described in the claims corresponds to the secondary code production unit 3. Additionally, the means are not limited to the units.

The primary code production unit 2 rearranges musical performance information included in a musical piece file 4 of the above-described format, and produces a primary code 5 in order to raise compression efficiency of the secondary code production unit 3. Moreover, the secondary code production unit 3 compresses the primary code 5 by a general-purpose compression system, and produces a secondary code 6.

That is, the primary code production unit 2 separates the track data of the file into a plurality of track data attributed to each channel, holds information indicating attribution to the channel, further separates the track data attributed to each channel for each information, integrates the separated information by each type of each information regardless of the attribution to the channel, and disposes each type of information in an independent region to thereby produce the primary code 5. The secondary code production unit 3 compresses each information disposed in each region of the primary code 5 by a predetermined compression method to produce the secondary code 6.

In this embodiment, as a general-purpose compression system adopted in the secondary code production unit 3, it is assumed that, for example, an LZ coding method, a Huffman coding method, a run length coding method, and further a system (e.g., LHA, ZIP, etc.) in which they are combined are used, but, needless to say, the present invention is not limited to them.

Figure 2:
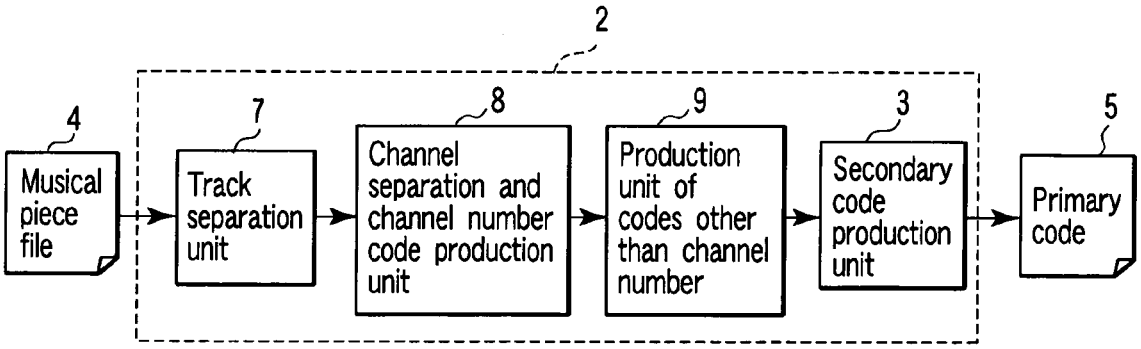
FIG. 2 is a block diagram showing a detailed constitution of a primary code production unit 2 in the musical performance information compression apparatus 1 according to one embodiment.

Here, a detailed constitution of the primary code production unit 2 is shown in FIG. 2.

That is, the primary code production unit 2 has a track separation unit 7, a channel separation and channel number code production unit 8, a production unit 9 of codes other than a channel number, and a code arrangement unit 10. Constitutions and functions of these units 7 to 10 will be described hereinafter in detail.

Figure 3:
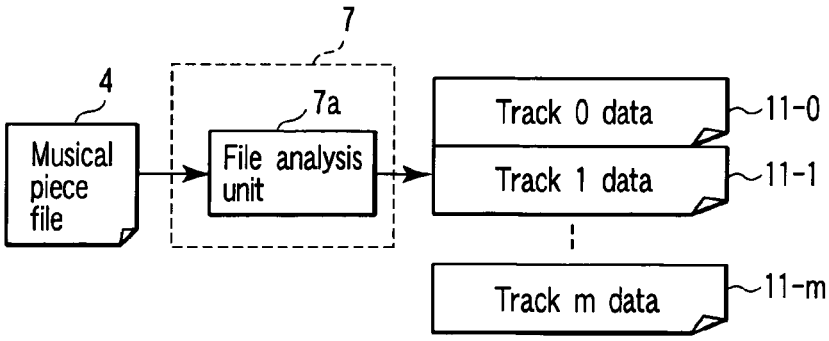
FIG. 3 is a block diagram showing a detailed constitution of a track separation unit 7 in the primary code production unit 2 of the musical performance information compression apparatus 1 according to one embodiment.

First, a detailed constitution of the track separation unit 7 is shown in FIG. 3.

That is, the track separation unit 7 has a file analysis unit 7*a*.

This file analysis unit 7*a* judges whether or not a plurality of track data are included in a track chunk of the musical piece file 4 based on information on the number of the track data included in the header chunk of the musical piece file 4. Moreover, when it is judged that the plurality of track data are included, the track chunk is separated into the respective track data. FIG. 3 shows an example in which the track chunk of the musical piece file 4 is separated into m+1 track data, that is, track 0 data 11-0, track 1 data 11-1, . . . , and track m data 11-*m*.

Figure 4:
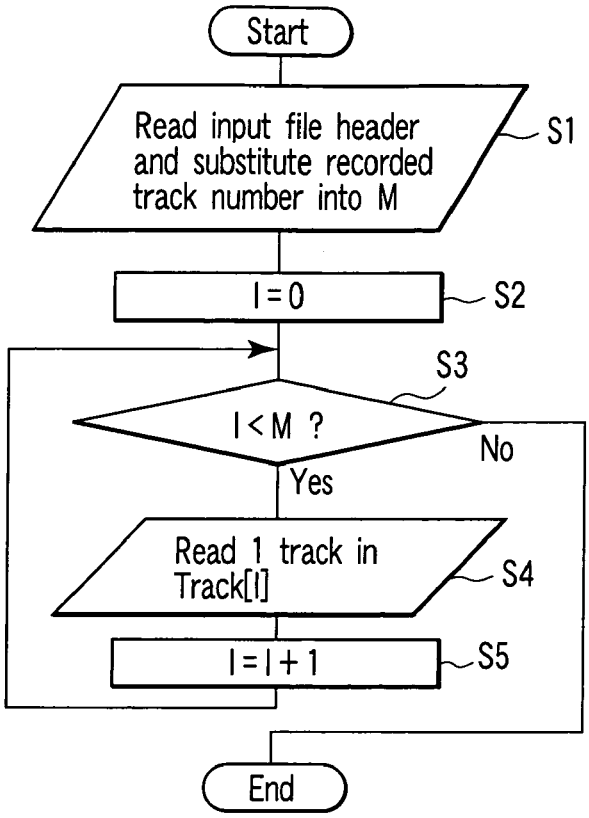
FIG. 4 is a flowchart showing a process relating to track separation by the track separation unit 7.

A flow of a process of track separation by the track separation unit 7 (in consideration of the file analysis unit 7*a*) will be described in further detail with reference to a flowchart of FIG. 4.

That is, when the process of the track separation starts, first the track separation unit 7 reads information of the header chunk of the input musical piece file 4, and substitutes a track number (m+1 tracks in FIG. 3) recorded in a part of the header chunk into a variable M (step S1). Subsequently, the track separation unit 7 successively reads the track 0 data 11-0, track 1 data 11-1, . . . , track m data 11-*m* as many as the tracks from the track chunk of the input musical piece file 4, and successively stores the data into an array of Track[0], Track[1], . . . , Track[m] (steps S2 to S5). Thus, the track separation unit 7 ends the process of the track separation.

Figure 5:
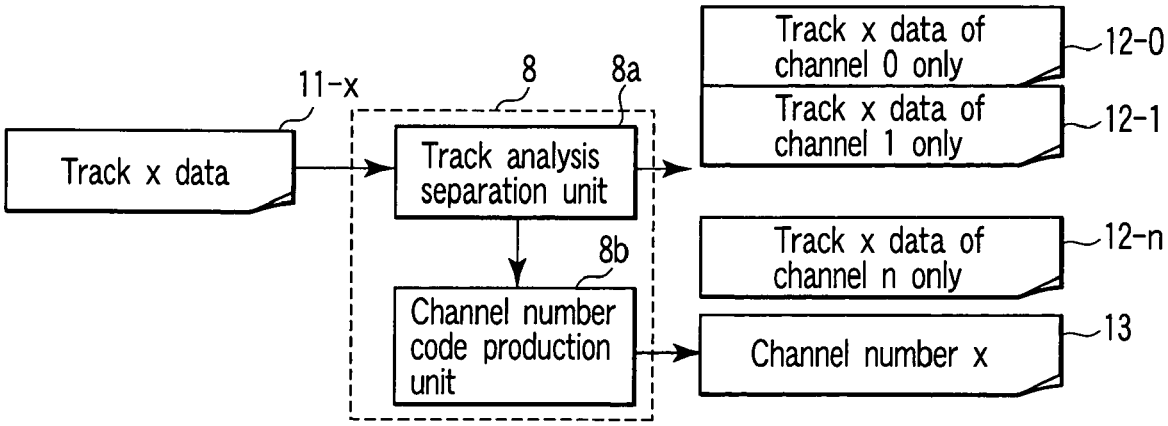
FIG. 5 is a block diagram showing a detailed constitution of a channel separation and channel number code production unit 8 in the primary code production unit 2 of the musical performance information compression apparatus 1 according to one embodiment.

Next, a detailed constitution of the channel separation and channel number code production unit 8 is shown in FIG. 5, and the channel separation and channel number code production unit 8 has a track analysis unit 8*a* and a channel number code production unit 8*b*.

The track analysis separation unit 8*a* analyzes whether or not the track data relating to a plurality of channels is included with respect to the track 0 data 11-0, track 1 data 11-1, . . . , track m data 11-*m* divided beforehand by the track separation unit 7. When it is analyzed that the data is included, the data is separated into track data constituted of a single channel. In the first embodiment, the track analysis separation unit 8a separates input track x data 11-*x* into track x data 12-0 of channel 0 only, track x data 12-1 of channel 1 only, . . . , track x data 12-*n* of channel n only. In this case, the channel number code production unit 8*b* produces a channel number code X13 of each data. The channel number code X13 corresponds to information indicating attribution to the channel described in the claims.

Here, the SMF is capable of including 16 channels at maximum in the track data as described above, and in the SMF format, an event attributed to the channel, and an event which is not attributed to the channel (an entirely influencing event, etc.) can be described. In view of this, in this embodiment, the event which does not belong to any channel is processed, assuming channel 0. That is, the event which does not belong to any channel is included in the track x data of the channel 0 only. Additionally, the present invention is not limited to this.

Moreover, in this embodiment, if all the tracks in which no event exists were coded, then the number of tracks would become enormous, therefore the tracks in which no event exists are deleted, and the events are not recorded in the primary code.

Figure 6:
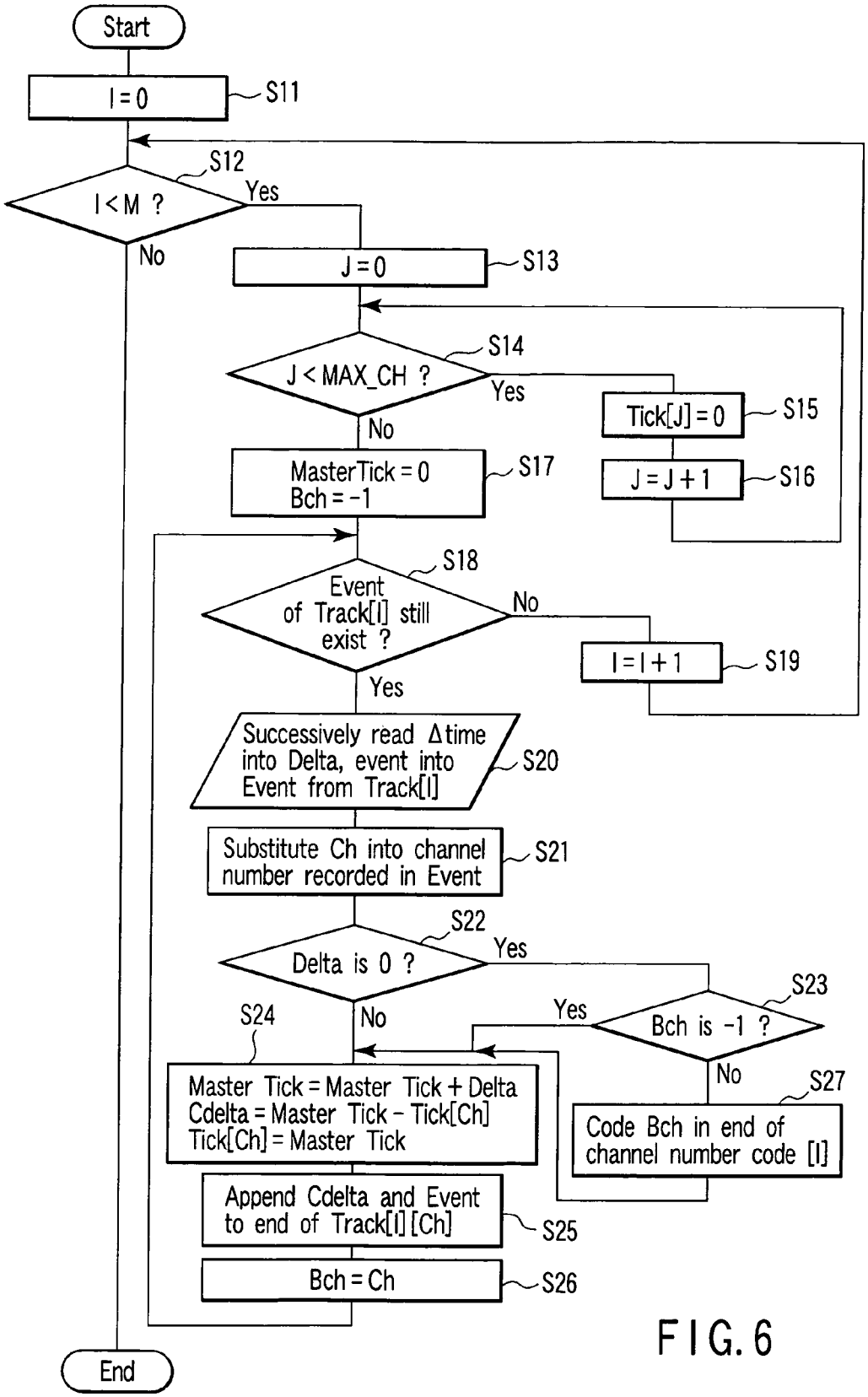
FIG. 6 is a flowchart showing a process relating to channel separation, and channel number code production according to the channel separation and channel number code production unit 8.

A flow of a process relating to channel separation, and channel number code production carried out by the channel separation and channel number code production unit 8 (track analysis separation unit 8*a*, channel number code production unit 8*b*) will be described with reference to a flowchart of FIG. 6 in further detail.

That is, when this process starts, first the channel separation and channel number code production unit 8 substitutes 0 into variable I relating to the track number (step S11), and thereafter compares this variable I with a maximum track number M (step S12). When judging in this step S12 that a relation of I<M is established, the channel separation and channel number code production unit 8 advances to Yes from this step S12, subsequently substitutes 0 into variable J relating to the channel number (step S13), and compares variable J relating to this channel number with maximum channel number MAX_CH (step S14).

Subsequently, when judging in the step S14 that a relation of J<MAX_CH is established, the channel separation and channel number code production unit 8 sets Tick[J] to 0 (step S15), thereafter increments variable J relating to the channel number by one (step S16), and returns to the step S14. Here, the Tick[J] means an elapsed time in the present coding position of track data J being coded. Since each track has an independent time axis, a process concerning this array Tick[J] is required. The channel separation and channel number code production unit 8 executes the process of the steps S14 to S16 with respect to all single channel track data separated from one track data.

For example, in a relation with FIG. 5, it is assumed that an event group belonging to channel 0 to n is included in track x data 11-*x*, and therefore the channel separation and channel number code production unit 8 repeats a process of the steps S14 to S16 to thereby set Tick[0], Tick[1], . . . , Tick[n] to 0.

After the process, the process advances on No from the step S14, then the channel separation and channel number code production unit 8 substitutes 0 into variable MasterTick, and substitutes −1 into variable Bch (step S17). This Bch is a variable indicating a channel number of the event immediately before the (previous) event being processed. Moreover, −1 substituted into Bch is a value indicating that the event being processed is on the top, and the previous event does not exist.

Subsequently, it is judged whether or not the event still exists in track I data stored in Track[I] (step S18). It is to be noted that MasterTick means a variable relating to an elapsed time in the present pursuit position of the track data in which the event group belonging to a plurality of channels to be separated is stored.

Moreover, when the channel separation and channel number code production unit 8 judges in the step S18 that the event still exists in the track I data of Track[I], the unit reads Δtime and event from the track I data, successively stores the Δtime into variable Delta, and the event into variable Event (step S20), and further stores the channel number included in the event stored in the variable Event into variable Ch (step S21). Subsequently, the channel separation and channel number code production unit 8 judges whether or not the Δtime in which the variable Delta is stored is 0, that is, the previous event is recorded in the same time (step S22). Moreover, when the channel separation and channel number code production unit 8 judges in the S22 that the Δtime is 0, it is judged whether or not the variable Bch is −1, that is, the previous event exists (step S23).

Moreover, when the channel separation and channel number code production unit 8 judges in the step S23 that the variable Bch is −1, that is, the previous event does not exist (the event being processed is in the head), the unit advances to a process of and after step S24. On the other hand, when the channel separation and channel number code production unit 8 judges in the step S23 that the variable Bch is not −1, that is, the event being processed is not in the head, the unit codes the channel number substituted into the variable Bch at the end of the channel number code [I], and advances to the process of and after the step S24 (step S27).

Subsequently, the channel separation and channel number code production unit 8 executes three processes as shown (step S24), adds the value stored in the variable Cdelta and the event stored in the variable Event to the end of Track [I][Ch] (step S25), further substitutes the channel number, which is assigned to variable Ch that indicates the channel number of the event in process, into variable Bch that indicates the channel number code of an event just before the event in process (step S26), and thereafter returns to the step S18.

The channel separation and channel number code production unit 8 repeats the above-described process as long as the event exists in the track I data of Track[I] (steps S18 to S26). Moreover, when the unit judges in the step S18 that another event does not exist in the track I data stored in the Track[I], the unit increments the variable I relating to the track number by one (step S19), thereafter returns to the step S12, and executes the above-described similar process with respect to the next track data.

Moreover, when the channel separation and channel number code production unit 8 repeats the above-described process up to the track m data 11-*m* stored in Track[m] in the relation with FIG. 3 described above, the unit ends the present process. By this series of processes, in the relation with FIG. 5, the channel separation and channel number code production unit 8 separates the input track x data 11-*x* into the track x data 12-0 of the channel 0 only, the track x data 12-1 of channel 1 only, . . . , and the track x data 12-*n* of channel n only, and produces a channel number code X of each data.

In the above-described process, it is not the channel number of the event in process but the channel number of the previous event that is coded. Accordingly, the process is devised not to code the channel number code located at the end of the event group in the same time.

Here, an effect by the process relating to the channel separation and channel number code generation by the above-described channel separation and channel number code production unit 8 (track analysis separation unit 8*a*, channel number code production unit 8*b*) will be described with reference to FIG. 7.

Figure 7A:
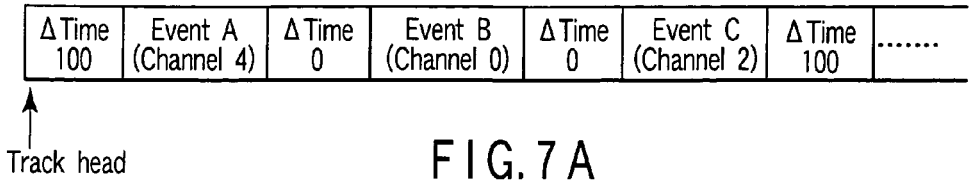
FIG. 7A is a diagram showing a constitution of track x data.
Figure 7B:
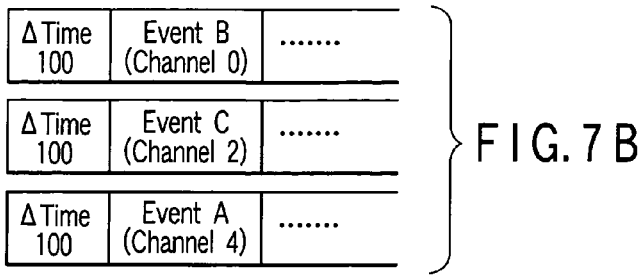
FIG. 7B is a diagram showing the track x data constituted of a single channel in which the track x data has been separated.

It is assumed that track x data of a certain track x is constituted as shown in FIG. 7A. Since the track x data relating to channels 4, 0, 2 are mixed in the track x data of this example as shown, the data is separated into the track x data of each channel only by the above-described process, and a state after the separation is shown in FIG. 7B. That is, an upper stage of FIG. 7B shows track x data constituted of single channel 0, a middle stage shows track x data constituted of single channel 2, and a lower stage shows track x data constituted of single channel 4.

When the data is decoded and returned to original information, it is seen that an order of arrangement of events A to C cannot be recognized only with information shown in FIG. 7B. For example, when the events are arranged in the order of the channel number, the order is the events B, C, A, and is different from that before division into the tracks.

Figure 7C:
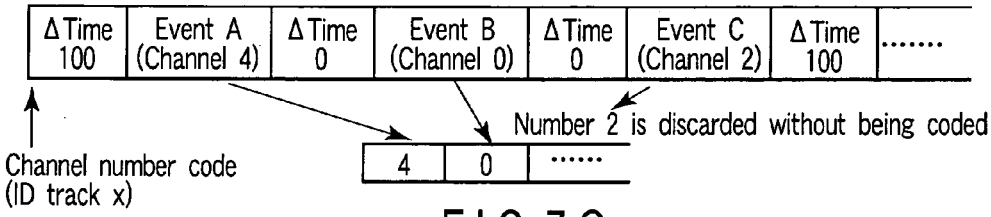
FIG. 7C is an explanatory view of an effect by a process relating to the channel number code production by the channel separation and channel number code production unit 8.

In view of this respect, in the embodiment, the channel number code X is adopted in order that the order of the events A, B, C can be recognized at a decoding time. This channel number code X is coded in a manner as shown in FIG. 7C, as long as there are a plurality of events that occurs at the same time. That is, the channel number concerning the event A, and the channel number concerning the event B are coded in order of arrangement of events.

For example, in the example of FIG. 7A, since the Δtime of the events B, C is 0, it is seen that these events A, B, C occur at the same time. However, it is seen that when the order of two from the head of three events A, B, C is determined, the order or the remaining one event is unnecessary. Then, in the first embodiment, n−1 channel number codes are coded in a case where there are n events at the same time.

That is, in the example of FIG. 7C, the channel number relating to the event C is not coded. In further detail, when the primary code production unit 2 judges that a plurality of events relating to the same time are recorded in the track data based on information (head byte of Δtime) of relative time between the events, the event recorded at the end of the event group at the same time is excluded from an object to hold the information indicating attribution to the channel. Even when the event is devised in this manner, reduction of a data amount is realized.

It is to be noted that all the tracks in which any event does not exist are coded, the track number becomes enormous. Therefore, in the first embodiment, the track in which any event does not exist is deleted at the time of the production of the primary code, and the track is not included in the primary code 5.

Figure 8:
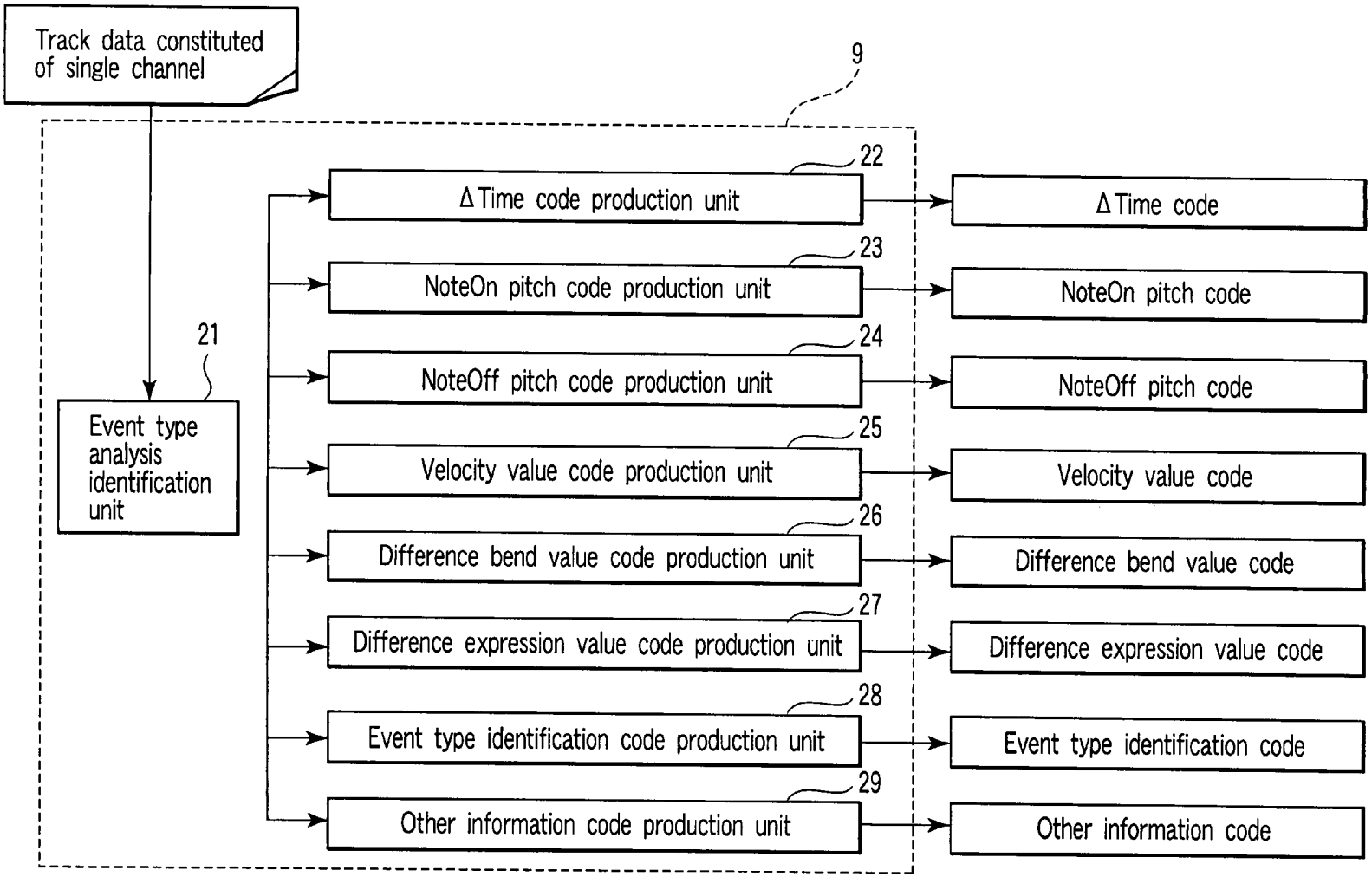
FIG. 8 is a block diagram showing a detailed constitution of a code production unit 9 of codes other than a channel number in the musical performance information compression apparatus 1 according to one embodiment.

Next, a detailed constitution of the code production unit 9 of codes other than the channel number is as shown in FIG. 8. That is, the code production unit 9 of the codes other than the channel number has an event type analysis recognition unit 21, a Δtime code production unit 22, a Note On pitch code production unit 23, a Note Off pitch code production unit 24, a velocity value code production unit 25, a difference bend value code production unit 26, a difference expression value code production unit 27, an event type identification code production unit 28, and other information code production unit 29 as shown.

Figure 9:
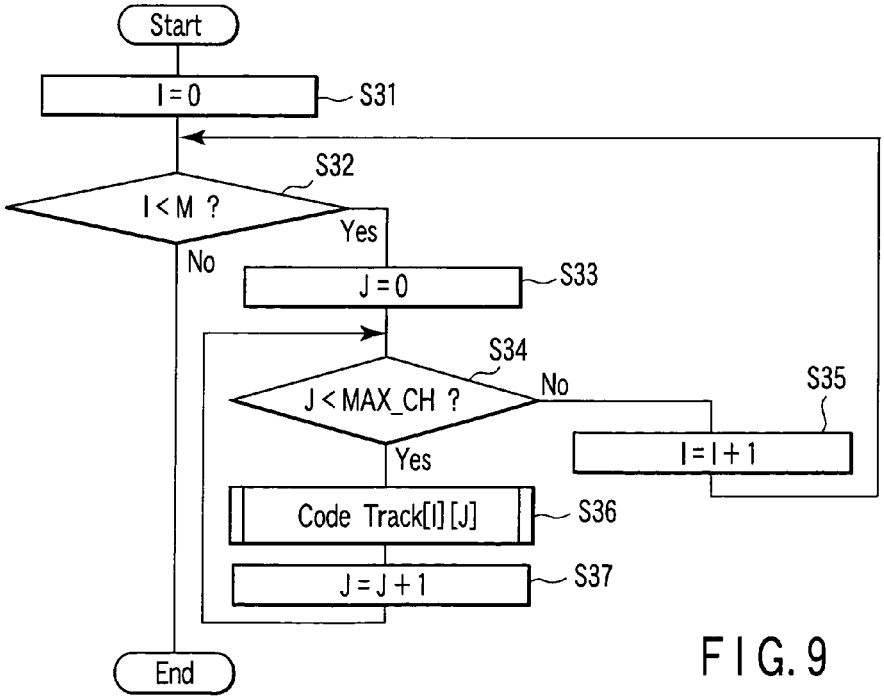
FIG. 9 is a flowchart showing a process of coding by the code production unit 9 of the codes other than the channel number.

A flow of a process carried out by the code production unit 9 (including the respective units 21 to 29) of the codes other than the channel number will be described hereinafter in detail with reference to a flowchart of FIG. 9.

When this process starts, first the code production unit 9 of the codes other than the channel number sets 0 to variable I relating to the track number (step S31), and compares this variable I with a maximum track number M (m+1 in the example of FIG. 3) (step S32).

Moreover, when judging that a relation of I<M is established, the code production unit 9 of the codes other than the channel number substitutes 0 into variable J relating to the channel number (step S33), and compares the variable J relating to this channel number with a predetermined maximum channel number MAX_CH (step S34). In a first loop, since J=0 is set beforehand in step S34, the code production unit 9 of the codes other than the channel number judges that a relation of J<MAX_CH is satisfied, and codes track 0 data of channel 0 only stored in Track[0][0] (step S36).

Moreover, after incrementing the variable J relating to the channel number by one to set J=1, the code production unit 9 of the codes other than the channel number repeats the process of the above-described steps S34 to 36 (step S37). Here, since the maximum channel number MAX_CH is set at 16 in the first embodiment, the code production unit 9 of the codes other than the channel number successively codes the track 0 data of channel 0 only, track 0 data of channel 1 only, . . . , track 0 data of channel 15 only stored in the Track[0][0], Track[0][1], . . . , Track[0][15].

Moreover, after the process concerning the track 0 data, the code production unit 9 of the codes other than the channel number increments the variable I relating to the track number by one to set I=1 (step S35), and successively codes track 1 data of channel 0 only, track 1 data of channel 1 only, . . . , track 1 data of channel 15 only stored in the Track[1][0], Track[1][1], . . . , Track[1][15] (steps S32 to S37). When the code production unit 9 of the codes other than the channel number successively codes the data up to track m data of channel 0 only, track m data of channel 1 only, . . . , track m data of channel 15 only stored in the Track[m][0], Track[m][1], . . . , Track[m][15] by a process similar to the above-described process (step S32 to S37), the unit ends this process.

Figure 10:
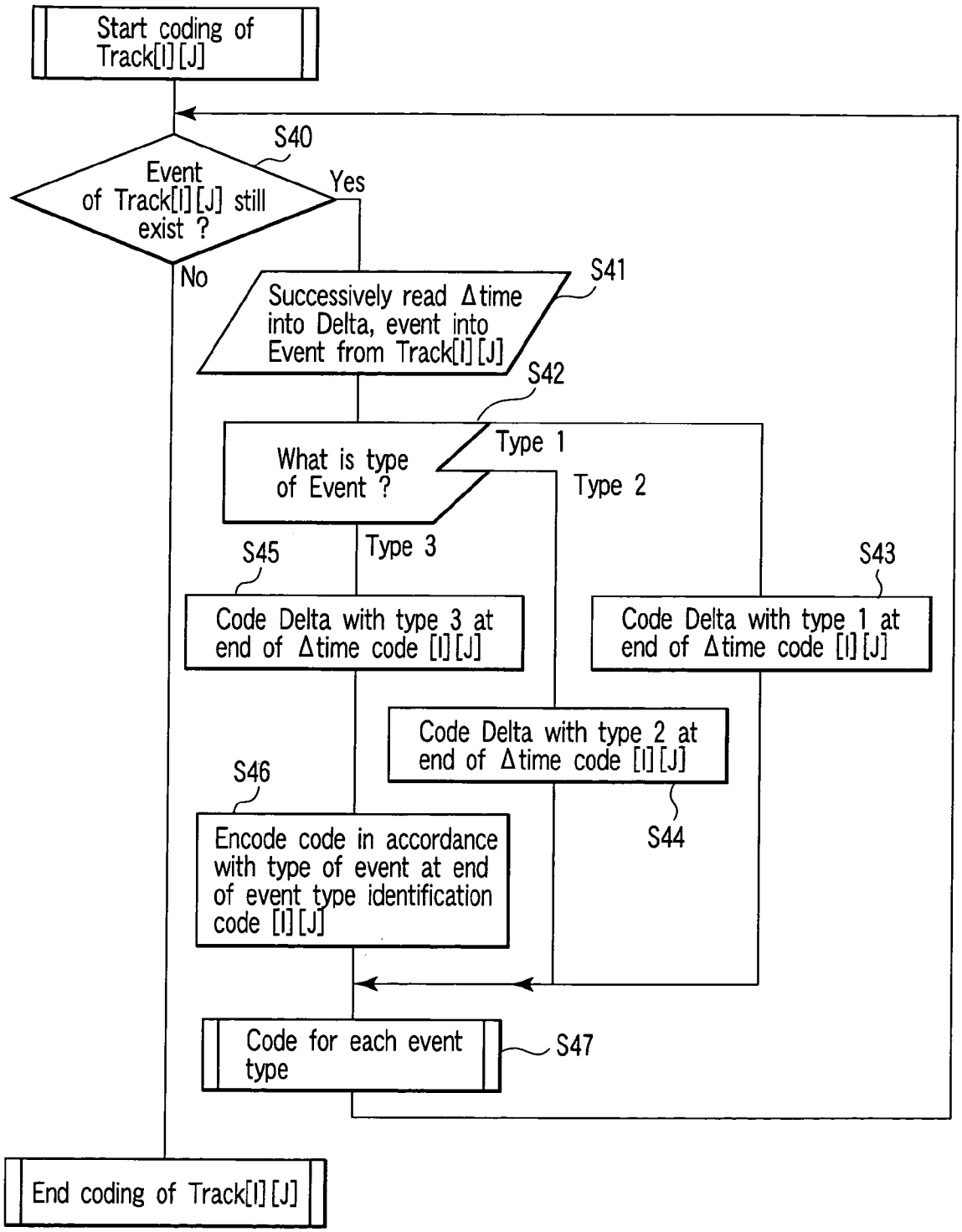
FIG. 10 is a flowchart further showing a process relating to coding of Track[I][J] executed in step S36 of FIG. 9 in more detail.

Here, a process of the coding of Track[I][J] executed in the step S36 of FIG. 9 will be described with reference to a flowchart of FIG. 10 in further detail.

When this process of the coding of Track[I][J] starts, the code production unit 9 of the codes other than the channel number judges whether or not the event exists in track I data of J channel only stored in Track[I][J] (step S40). In this step S40, when the code production unit 9 of the codes other than the channel number judges that the event exists in the track I data of the J channel only, the unit reads Δtime and event from the data of Track[I][J], and stores the Δtime in variable Delta, and the event into the variable Event (step S41). Moreover, the code production unit 9 of the codes other than the channel number judges the type of the event stored in this Event (step S42).

To judge this event type, a data row included in Event is judged based on format specifications of SMF. That is, in the step S42, when the code production unit 9 of the codes other than the channel number judges that the event stored in the variable Event is the event corresponding to type 1 in FIG. 48, the unit codes the Δtime stored in the variable delta with the type 1 at the end of Δtime code [I][J] (step S43). On the other hand, when the code production unit 9 of the codes other than the channel number judges that the event stored in the variable Event is an event corresponding to type 2 in FIG. 48 in the step S42, the unit codes delta time stored in the variable delta with type 2 at the end of the Δtime code [I][J] (step S44).

On the other hand, in the step S42, when the code production unit 9 of the codes other than the channel number judges that the event stored in the variable Event is the event corresponding to type 3 in FIG. 48, the unit codes the delta time stored in the variable delta with the type 3 at the end of the Δtime code [I][J] (step S45), and further encodes the code in accordance with the type of the variable Event at the end of the event type identification code [I][J] (step S46). The coding is performed in this manner while an independent Δtime capable of identifying the event type is defined. Accordingly, when the event of the type 1 and 2 is judged in the step S42, the event type identification code recorded in step S46 can be omitted, and therefore the data amount is reduced.

Thus, although details are described later, the code production unit 9 of the codes other than the channel number performs the coding by each event type (step S47), repeats the above-described process (steps S40 to S47) as long as the event exists in Track[I][J], and performs the process with respect to all the events (step S40). Then, the process of coding this Track[I][J] ends, and the process returns to the S36 of FIG. 9.

Here, the primary code production unit 2 calculates information of the relative time between the respective events, that is, greatest common divisor of the Δtime, and codes a numerical value obtained by dividing the Δtime by the greatest common divisor. That is, the primary code production unit 2 codes the value obtained by dividing the Δtime by the greatest common divisor, when the Δtime is a variable length code. Accordingly, reduction of a capacity in a whole musical piece is realized.

Figure 11:
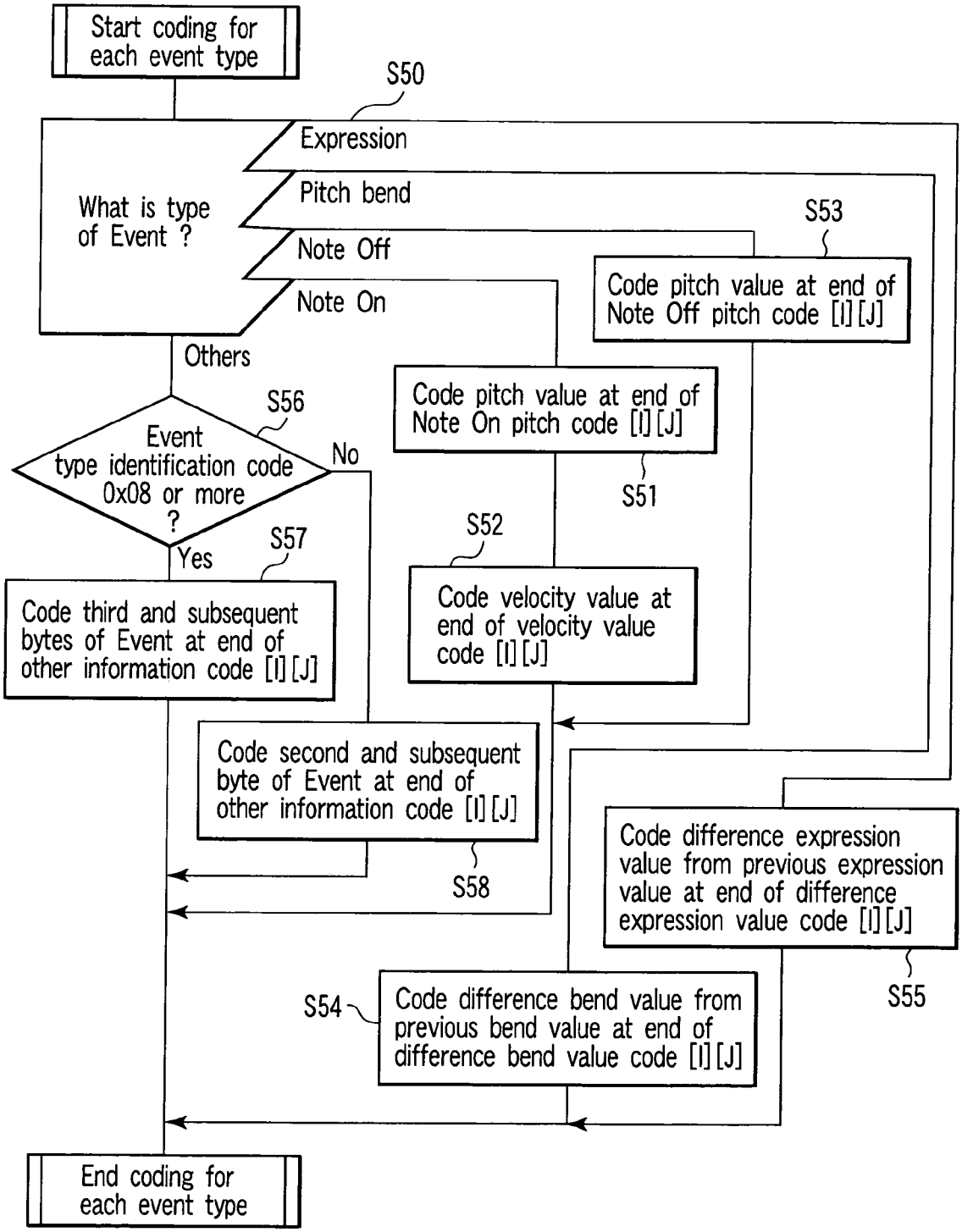
FIG. 11 is a flowchart showing a process relating to the coding for each event executed in step S47 of FIG. 10 in more detail.

Next, a process of the coding for each event type executed in step S47 of FIG. 10 will be described in more detail with reference to a flowchart of FIG. 11.

When the coding of each event type starts, the code production unit 9 of the codes other than the channel number identifies the type of the event stored in variable Event (step S50), and thereafter the code production unit 9 of the codes other than the channel number performs a different coding process for each identified event (steps S51 to S58).

That is, when the code production unit 9 of the codes other than the channel number judges that the type of the event is Note On, the unit codes a pitch value at the end of Note On pitch code [I][J] (step S51), and codes a velocity value at the end of a velocity value code [I][J] (step S52). On the other hand, when the code production unit 9 of the codes other than the channel number judges that the type of the event is Note Off, the unit codes the pitch value at the end of Note Off pitch code [I][J] (step S53). When the code production unit 9 of the codes other than the channel number judges that the type of the event is a pitch bend, the unit codes a difference bend value from the previous bend value at the end of the difference bend value code [I][J] (step S54).

Moreover, when the code production unit 9 of the codes other than the channel number judges that the type of the event is expression, the unit codes a difference expression value from the previous expression value at the end of the difference expression value code [I][J] (step S55). Moreover, the code production unit 9 of the codes other than the channel number judges that the type of the event is others, the unit subsequently judges whether or not a type identification code of the event is 0x08 or more (see FIG. 21) (step S56).

Moreover, when the code production unit 9 of the codes other than the channel number judges in the step S56 that the code is 0x08 (see FIG. 21) or more, the unit codes information of and after third byte of the event stored in the variable Event at the end of another information code [I][J]. On the other hand, when the code production unit 9 of the codes other than the channel number judges in the above-described step S56 that the code (hexadecimal) is less than 0x08 (see FIG. 21), the unit codes information of and after second byte of the event stored in the variable Event at the end of the other information code [I][J] (step S57).

Thus, the code production unit 9 of the codes other than the channel number ends the process of the coding of each event type. It is to be noted that in the first embodiment, since the velocity of Note Off is not generally used in the above-described coding process of each event type, the velocity of Note Off is discarded without being coded, and the data amount is reduced.

Figure 12:
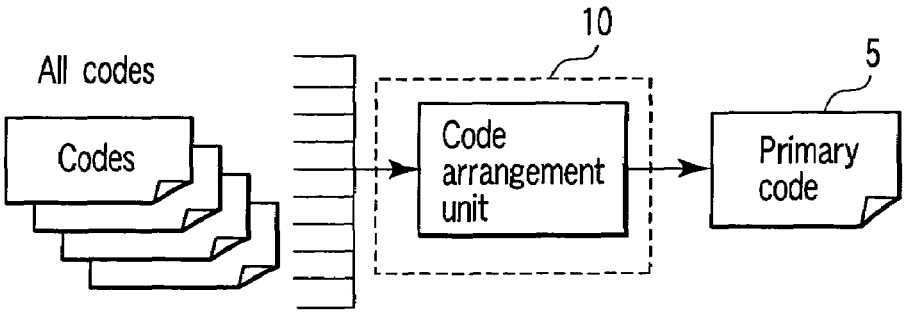
FIG. 12 is a block diagram showing a detailed constitution of a code arrangement unit 10 in the primary code production unit 2 of the musical performance information compression apparatus 1 according to one embodiment.

As described above, the code production unit 9 (including the respective production units 22 to 29) of the codes other than the channel number produces the Δtime code, Note On pitch code, Note Off pitch code, velocity value code, difference bend value code, difference expression value code, event type identification code, and other information code by the above-described series of processes. Moreover, all these codes are input into the code arrangement unit 10 as shown in FIG. 12. Moreover, the code arrangement unit 10 arranges the respective codes for each type, and produces the primary code 5.

A flow of a process of code arrangement by the code arrangement unit 10 of the musical performance information compression apparatus 1 according to one embodiment will be described in more detail with reference to FIGS. 13 to 23.

Additionally, when the present process is started, the code arrangement unit 10 first arranges the codes of the header chunk (step S60). Thereafter, the unit executes the arrangement of the respective codes.

First, the code arrangement unit 10 arranges the Δtime codes (step S61).

Figure 14:
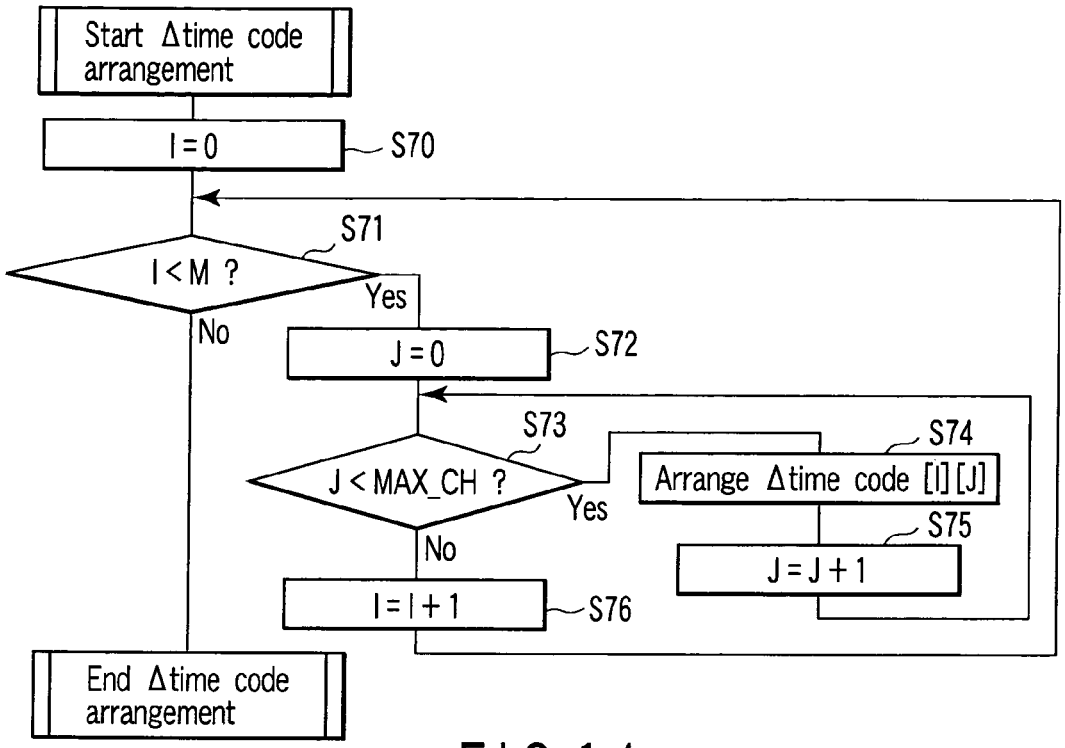
FIG. 14 is a flowchart showing a process relating to Δtime code arrangement executed in step S61 of FIG. 13 in further detail.

That is, as shown in the flowchart of FIG. 14 in detail, the code arrangement unit 10 first substitutes 0 into variable I relating to the track number (step S70), and thereafter judges whether or not this I is smaller than the track number M (step S71).

Since I=0 is set in the step S70 in a first loop, the code arrangement unit 10 advances to Yes side from the step S71. Moreover, the code arrangement unit 10 next substitutes 0 into J relating to the channel number (step S72).

Subsequently, the code arrangement unit 10 judges whether or not the variable J relating to this channel number is smaller than the maximum channel number MAX_CH (step S73).

Moreover, since J=0 is set in the above-described step S72 in the first loop, the code arrangement unit 10 advances to Yes from the step S73. Moreover, after arranging the Δtime code [0][0] (step S74), the code arrangement unit 10 increments the variable J relating to the channel number to set J=1 (step S75).

Since the maximum channel number MAX_CH is set to 16 in the first embodiment, the code arrangement unit 10 repeats the process of the above-described steps S73 to S75, and successively arranges Δtime code [0][1], Δtime code [0][2], . . . , Δtime code [0][15]. After arranging the Δtime code [0][15], the code arrangement unit 10 advances to No side from the step S73, increments the variable I relating to the track number by one to set I=1, thereafter repeats the process of the steps S71 to S75 again, and subsequently successively arranges Δtime code [1][1], Δtime code [1][2], . . . , Δtime code [1][15]. Additionally, in this example, as shown in FIG. 3, it is assumed that m+1 is set to M relating to the track number.

Figure 13:
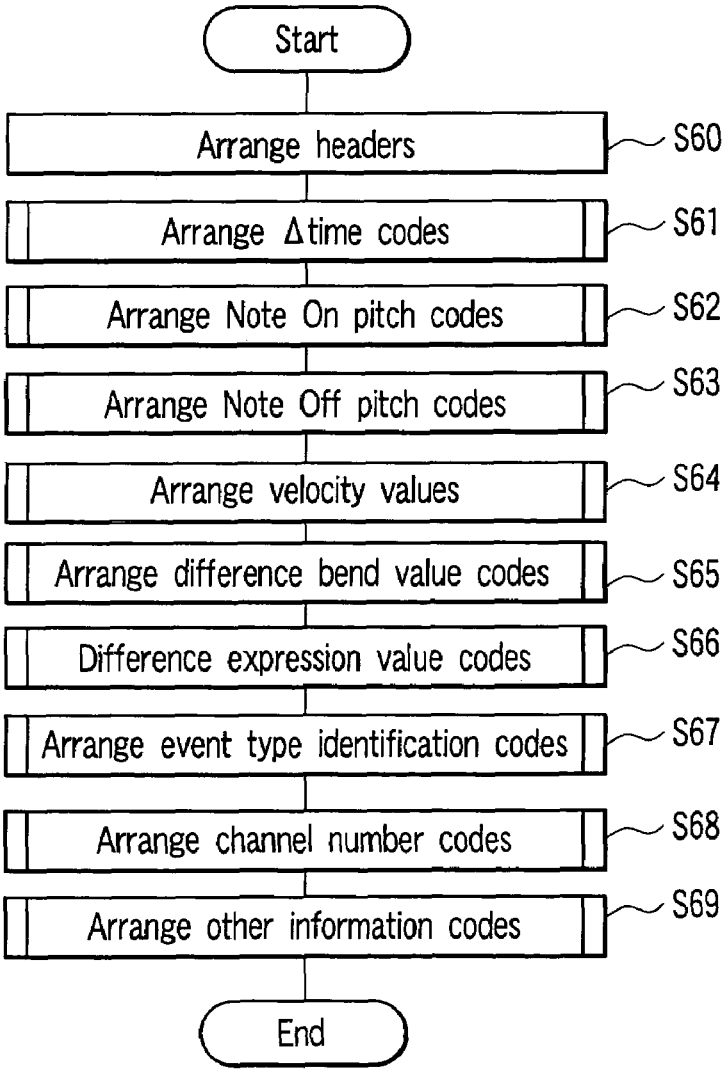
FIG. 13 is a flowchart showing a process of code arrangement by the code arrangement unit 10.

Therefore, when the code arrangement unit 10 repeats the process of the above-described steps S71 to S75, and finally successively arranges Δtime code [m][1], Δtime code [m][2], . . . , Δtime code [m][15] relating to the track m data, the unit ends this delta time code arrangement process, and returns to the step S61 of FIG. 13.

Subsequently, the code arrangement unit 10 arranges Note On pitch codes (step S62).

Figure 15:
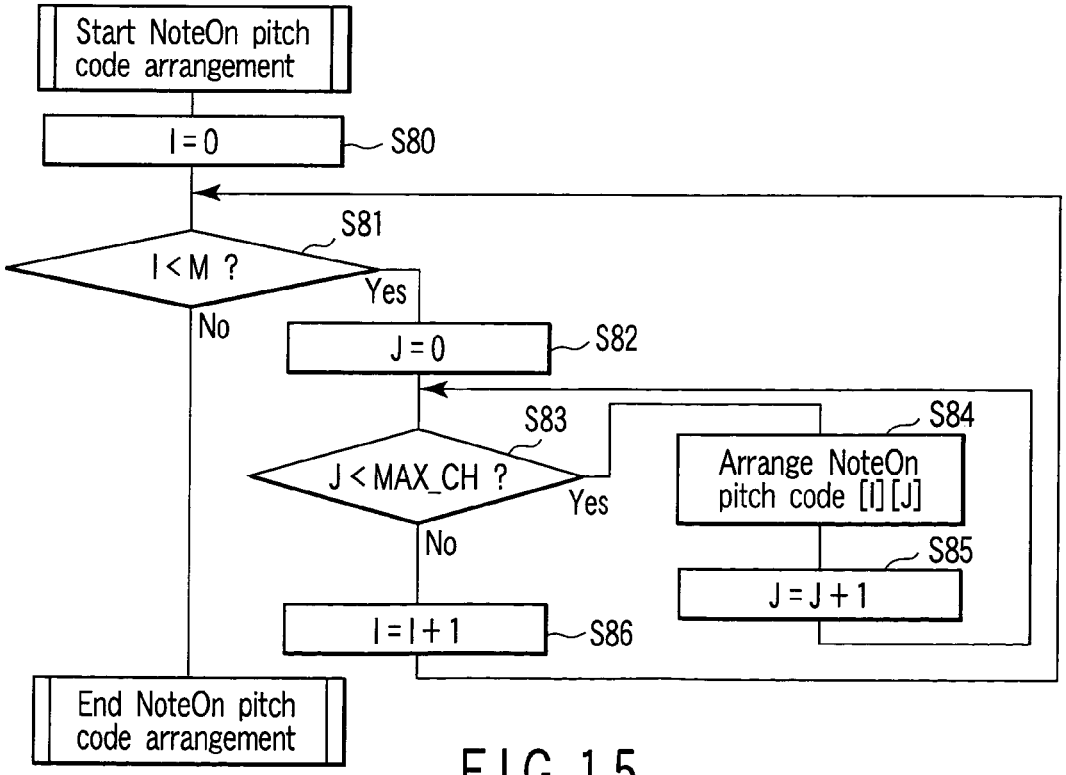
FIG. 15 is a flowchart showing a process relating to Note On pitch code arrangement executed in step S62 of FIG. 13 in further detail.

That is, as shown in the flowchart of FIG. 15 in detail, the code arrangement unit 10 substitutes 0 into the variable I relating to the track number (step S80), and thereafter judges whether or not this variable I is smaller than the track number M (step S81).

Since I=0 is set in the step S80 in the first loop, the code arrangement unit 10 advances to the Yes side from the step S81. Moreover, the code arrangement unit 10 substitutes 0 into the variable J relating to the channel number (step S82).

Subsequently, the code arrangement unit 10 judges whether or not the variable J relating to this channel number is smaller than the maximum channel number MAX_CH (step S83).

Moreover, since J=0 is set in the above-described step S82 in the first loop, the code arrangement unit 10 advances to the Yes side from the step S83. Moreover, after arranging the Note On pitch code [0][0] (step S84), the unit increments the variable J relating to the channel number by one to set J=1 (step S85). Since the maximum channel number MAX_CH is set to 16 in the first embodiment, the code arrangement unit 10 repeats the process of the above-described steps S83 to S85, and successively arranges Note On pitch code [0][1], Note On pitch code [0][2], . . . , Note On pitch code [0][15].

Subsequently, after arranging the Note On pitch code [0][15], the code arrangement unit 10 advances to the No side from the step S83. Moreover, the code arrangement unit 10 increments I relating to the track number by one to set I=1, thereafter repeats the process of the steps S81 to S85, and subsequently successively arranges Note On pitch code [1][1], Note On pitch code [1][2], . . . , Note On pitch code [1][15].

Additionally, in this example, as shown in FIG. 3, m+1 is set to the track number M. Therefore, when the code arrangement unit 10 repeats the process of the above-described steps S71 to S75, and finally successively arranges Note On pitch code [m][1], Note On pitch code [m][2], . . . , Note On pitch code [m][15] relating to the track m data, the unit ends this Note On pitch code arrangement process, and returns to the step S62 of FIG. 13.

Subsequently, the code arrangement unit 10 arranges Note Off pitch codes (step S63).

Figure 16:
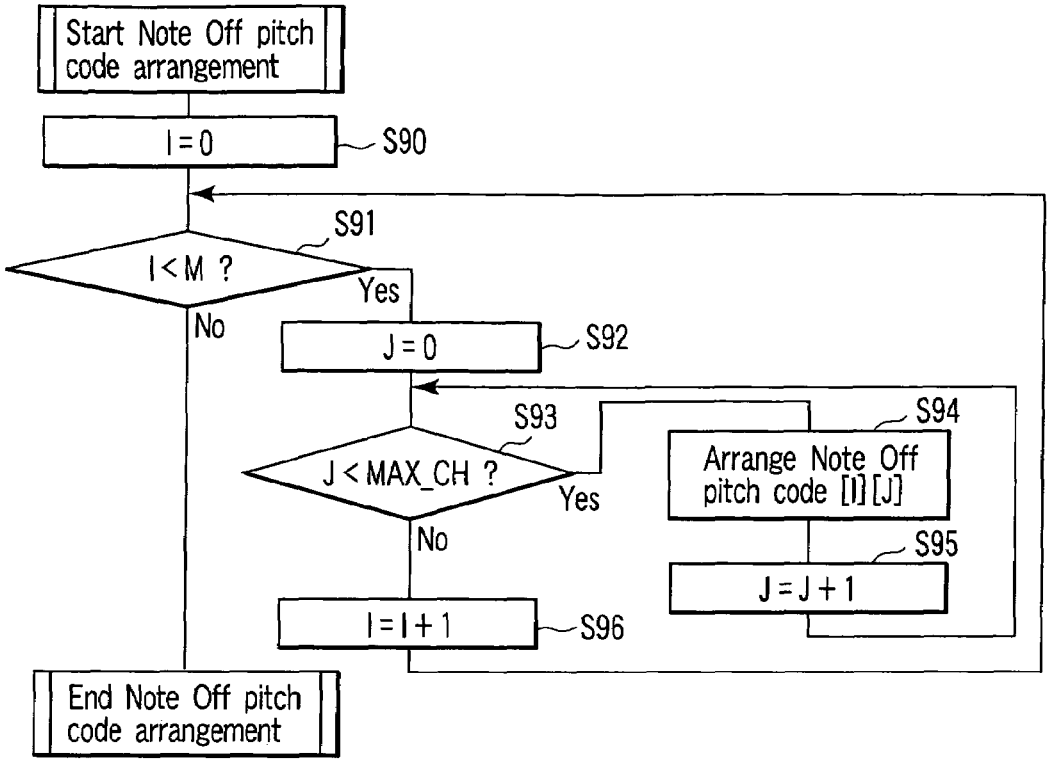
FIG. 16 is a flowchart showing the process relating to Note Off pitch code arrangement executed in step S63 of FIG. 13 in further detail.

That is, as shown in the flowchart of FIG. 16 in detail, the code arrangement unit 10 substitutes 0 into the variable I relating to the track number (step S90), and thereafter judges whether or not this variable I is smaller than the track number M (step S91).

First, since I=0 is set in the step S90 in the first loop, the code arrangement unit 10 advances to the Yes side from the step S91, and substitutes 0 into the variable J relating to the channel number (step S92).

Subsequently, the code arrangement unit 10 judges whether or not the variable J relating to this channel number is smaller than the maximum channel number MAX_CH (step S93).

Moreover, since J=0 is set in the above-described step S92 in the first loop, the code arrangement unit 10 advances to Yes from the step S93, arranges the Note Off pitch code [0][0] (step S94), and increments J relating to the channel number by one to set J=1 (step S95). Here, since 16 is set to the maximum channel number MAX_CH beforehand in the first embodiment, the code arrangement unit 10 subsequently repeats the process of the steps S93 to S95, and successively arranges Note Off pitch code [0][1], Note Off pitch code [0][2], . . . , Note Off pitch code [0][15].

Subsequently, after arranging the Note Off pitch code [0][15], the code arrangement unit 10 branches to No from the step S93, increments I relating to the track number by one to set I=1, thereafter repeats the process of the steps S91 to S95 again, and successively arranges Note Off pitch code [1][1], Note Off pitch code [1][2], . . . , Note Off pitch code [1][15]. Additionally, in this example, as shown in FIG. 3, it is assumed that m+1 is set to M relating to the track number.

Therefore, when the code arrangement unit 10 repeats the process of the above-described steps S91 to S95, and finally successively arranges Note Off pitch code [m][1], Note Off pitch code [m][2], . . . , Note Off pitch code [m][15] relating to the track m data, the unit ends this Note Off pitch code arrangement process, and returns to the step S63 of FIG. 13.

Subsequently, the code arrangement unit 10 arranges velocity value codes (step S64).

Figure 17:
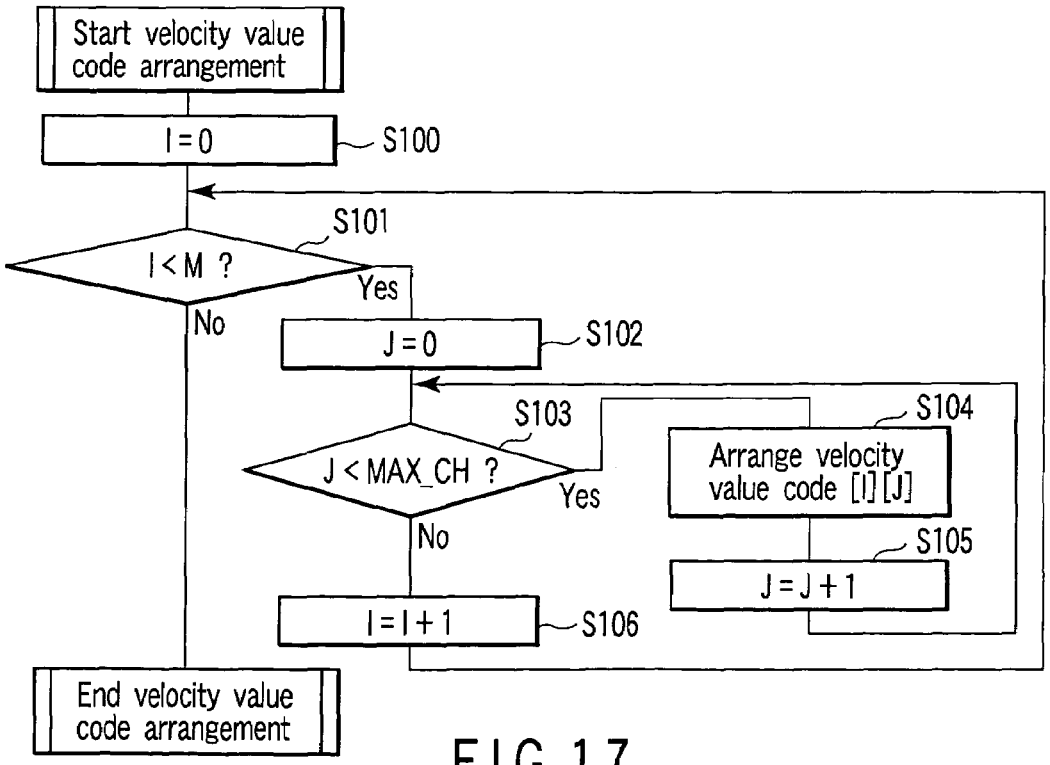
FIG. 17 is a flowchart showing a process relating to velocity value code arrangement executed in step S64 of FIG. 13 in further detail.

That is, as shown in the flowchart of FIG. 17 in detail, the code arrangement unit 10 substitutes 0 into the variable I relating to the track number (step S100), and thereafter judges whether or not this variable I is smaller than the track number M (step S101).

Since I=0 is set in the step S100 in the first loop, the code arrangement unit 10 advances to Yes from the step S101, and subsequently substitutes 0 into J relating to the channel number (step S102). Subsequently, the code arrangement unit 10 judges whether or not the variable J relating to this channel number is smaller than the maximum channel number MAX_CH (step S103). Since J=0 is set in the above-described step S102 in the first loop, the code arrangement unit 10 advances to Yes from the step S103, arranges the velocity value code [0][0] (step S104), and thereafter increments J relating to the channel number by one (step S105). Since 16 is set to the maximum channel number MAX_CH beforehand in the first embodiment, the code arrangement unit 10 thereafter repeats the process of the above-described steps S103 to S105, and successively arranges velocity value code [0][1], velocity value code [0][2], . . . , velocity value code [0][15].

Subsequently, after arranging the velocity value code [0][15], the code arrangement unit 10 advances to No from the step S103, increments I relating to the track number by one to set I=1, thereafter repeats the process of the steps S101 to S105, and subsequently successively arranges velocity value code [1][1], velocity value code [1][2], . . . , velocity value code [1][15]. In this example, as shown in FIG. 3, m+1 is set to M relating to the track number.

Therefore, when the code arrangement unit 10 repeats the process of the above-described steps S101 to S105, and finally successively arranges velocity value code [m][1], velocity value code [m][2], . . . , velocity value code [m][15] relating to the track m data, the unit ends this velocity value code arrangement process, and returns to the step S64 of FIG. 13.

Subsequently, the code arrangement unit 10 arranges difference bend value codes (step S65).

Figure 18:
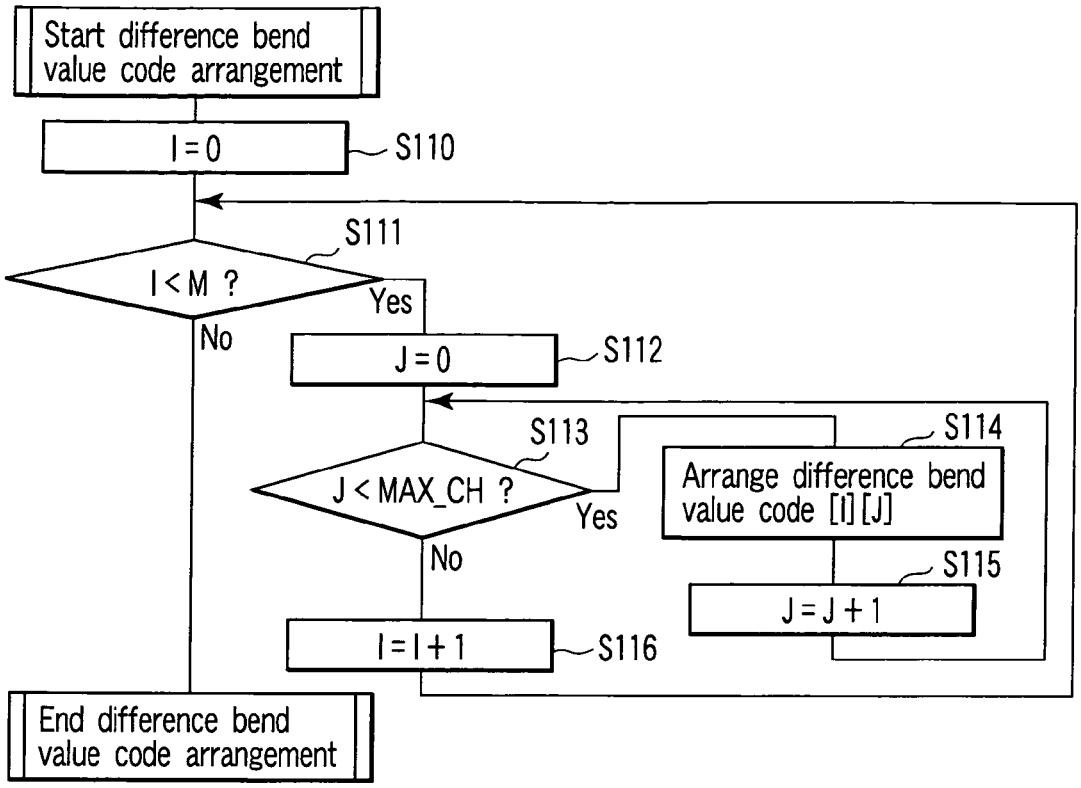
FIG. 18 is a flowchart showing a process relating to difference bend value code arrangement executed in step S65 of FIG. 13 in further detail.

That is, as shown in the flowchart of FIG. 18 in detail, the code arrangement unit 10 substitutes 0 into the variable I relating to the track number (step S110), and thereafter judges whether or not this variable I is smaller than the track number M (step S111).

Since I=0 is set in the step S110 in the first loop, the code arrangement unit 10 advances to Yes from the step S111. Moreover, the code arrangement unit 10 substitutes 0 into the variable J relating to the channel number (step S112).

Subsequently, the code arrangement unit 10 judges whether or not the variable J relating to this channel number is smaller than the maximum channel number MAX_CH (step S113).

Moreover, since J=0 is set in the above-described step S112 in the first loop, the code arrangement unit 10 advances to Yes from the step S113, arranges the difference bend value code [0][0] (step S114), and thereafter increments the variable J relating to the channel number by one to set J=1 (step S115). Since 16 is set to MAX_CH relating to the maximum channel number beforehand in the first embodiment, the code arrangement unit 10 repeats the process of the above-described steps S113 to S115, and successively arranges difference bend value code [0][1], difference bend value code [0][2], . . . , difference bend value code [0][15].

Moreover, after arranging the difference bend value code [0][15], the code arrangement unit 10 advances to No from the step S113, increments the track number I by one to set I=1, thereafter repeats the process of the steps S111 to S115, and subsequently successively arranges difference bend value code [1][1], difference bend value code [1][2], . . . , difference bend value code [1][15]. Additionally, in this example, it is assumed that, as shown in FIG. 3, m+1 is set to the track number M.

Therefore, when the code arrangement unit 10 repeats the process of the above-described steps S111 to S115, and finally successively arranges difference bend value code [m][1], difference bend value code [m][2], . . . , difference bend value code [m][15] relating to the track m data, the unit ends this difference bend value code arrangement process, and returns to the step S65 of FIG. 13.

Figure 19:
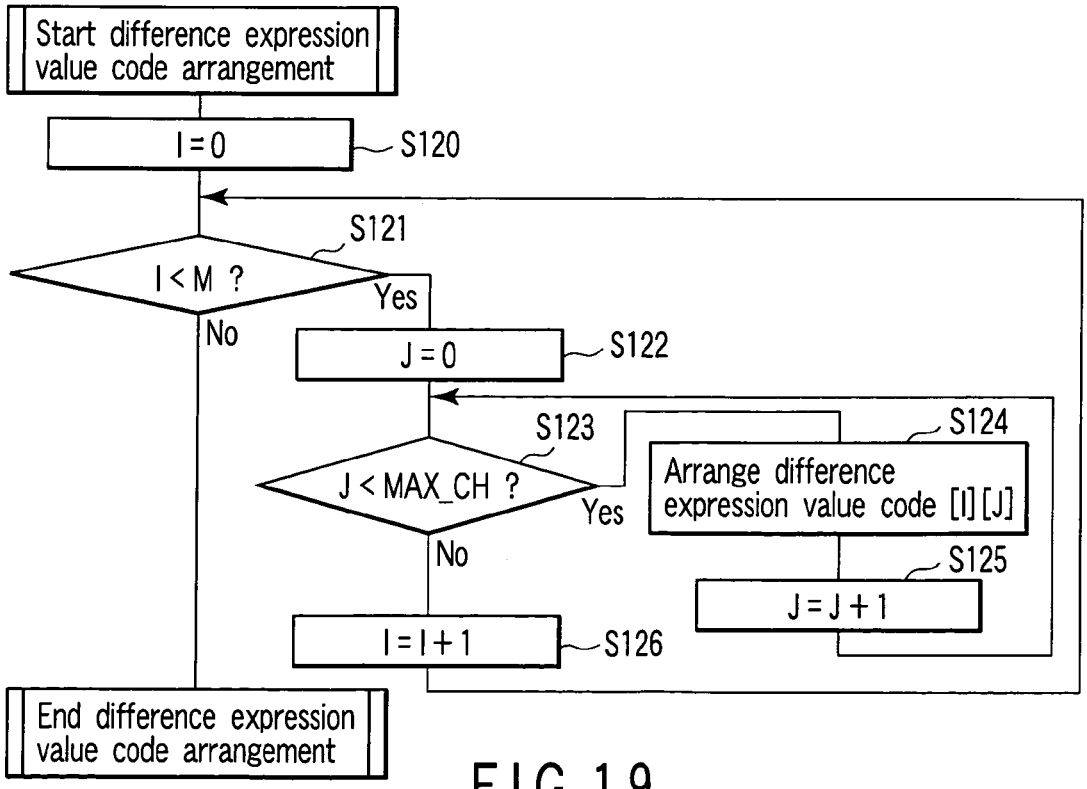
FIG. 19 is a flowchart showing a process relating to difference expression value code arrangement executed in step S66 of FIG. 13 in further detail.

Subsequently, the code arrangement unit 10 arranges difference expression value codes (step S66). That is, as shown in the flowchart of FIG. 19 in detail, the code arrangement unit 10 substitutes 0 into the variable I relating to the track number (step S120), and thereafter judges whether or not this variable I is smaller than the track number M (step S121).

Since I=0 is set in the above-described step S120 in the first loop, the code arrangement unit 10 advances to Yes from the step S121, and next substitutes 0 into the variable J relating to the channel number (step S122). Subsequently, the code arrangement unit 10 judges whether or not the variable J relating to this channel number is smaller than the maximum channel number MAX_CH (step S123). Since J=0 is set in the above-described step S122 in the first loop, the code arrangement unit 10 advances to Yes from the step S123.

Moreover, after arranging the difference expression value code [0][0] (step S124), the code arrangement unit 10 increments the variable J relating to the channel number by one to set J=1 (step S125). Since 16 is set to MAX_CH relating to the maximum channel number beforehand in the first embodiment, the code arrangement unit 10 thereafter repeats the process of the above-described steps S123 to S125, and successively arranges difference expression value code [0][1], difference expression value code [0][2], . . . , difference expression value code [0][15]. Moreover, after arranging the difference expression value code [0][15], the code arrangement unit 10 advances to No from the step S123, increments the variable I relating to the track number by one to set I=1, thereafter repeats the process of the steps S121 to S125, and subsequently successively arranges difference expression value code [1][1], difference expression value code [1][2], . . . , difference expression value code [1][15]. Additionally, in this example, it is assumed that as shown in FIG. 3, m+1 is set to the track number M.

Therefore, the code arrangement unit 10 repeats the process of the above-described steps S121 to S125, and finally successively arranges difference expression value code [m][1], difference expression value code [m][2], . . . , difference expression value code [m][15] relating to the track m data, the unit ends this difference expression value code arrangement process, and returns to the step S66 of FIG. 13.

Subsequently, the code arrangement unit 10 arranges event type identification codes (step S67). That is, as shown in the flowchart of FIG. 20 in detail, the code arrangement unit 10 substitutes 0 into the variable I relating to the track number (step S130), and thereafter judges whether or not this variable I is smaller than the track number M (step S131).

Since I=0 is set in the step S130 in the first loop, the code arrangement unit 10 advances to Yes from the step S131, and substitutes 0 into the variable J relating to the channel number (step S132). Subsequently, the code arrangement unit 10 judges whether or not the variable J relating to this channel number is smaller than the maximum channel number MAX_CH (step S133). First, since J=0 is set in the above-described step S132 in the first loop, the code arrangement unit 10 advances to Yes from the step S133, arranges the event type identification code [0][0] (step S134), and thereafter increments J relating to the channel number by one to set J=1 (step S135).

Since 16 is set to MAX_CH relating to the maximum channel number beforehand in this embodiment, the code arrangement unit 10 thereafter repeats the process of the steps S133 to S135, and thereafter successively arranges event type identification code [0][1], event type identification code [0][2], . . . , event type identification code [0][15].

Subsequently, after arranging the event type identification code [0][15], the code arrangement unit 10 advances to No from the step S133, increments the variable I relating to the track number by one to set I=1, thereafter repeats the process of the above-described steps S131 to S135 again, and subsequently successively arranges event type identification code [1][1], event type identification code [1][2], . . . , event type identification code [1][15]. Additionally, in this example, it is assumed that, as shown in FIG. 3, m+1 is set to the track number M.

Therefore, when the code arrangement unit 10 repeats the process of the above-described steps S131 to S135, and finally successively arranges event type identification code [m][1], event type identification code [m][2], . . . , event type identification code [m][15] relating to the track m data, the unit ends this event type identification code arrangement process, and returns to the step S67 of FIG. 13.

It is to be noted that the event type identification codes are appropriate assigned in accordance with the event type according to an event type identification code coding table shown in FIG. 21. In this example, 0x08 or more is assigned to the event relating to control change.

Moreover, it is also possible to dynamically assign the codes in accordance with an event type appearance frequency at a coding time. That is, in this case, the primary code production unit 2 assigns the event type identification code which differs with a high/low appearance frequency to each event included in the track data, integrates the event type identification codes, and arranges the codes in independent regions. Even by the devising at the time of primary coding, needless to say, compression efficiency by Huffman coding at the time of subsequent secondary coding is enhanced.

Subsequently, the code arrangement unit 10 arranges channel number codes (step S68).

Figure 22:
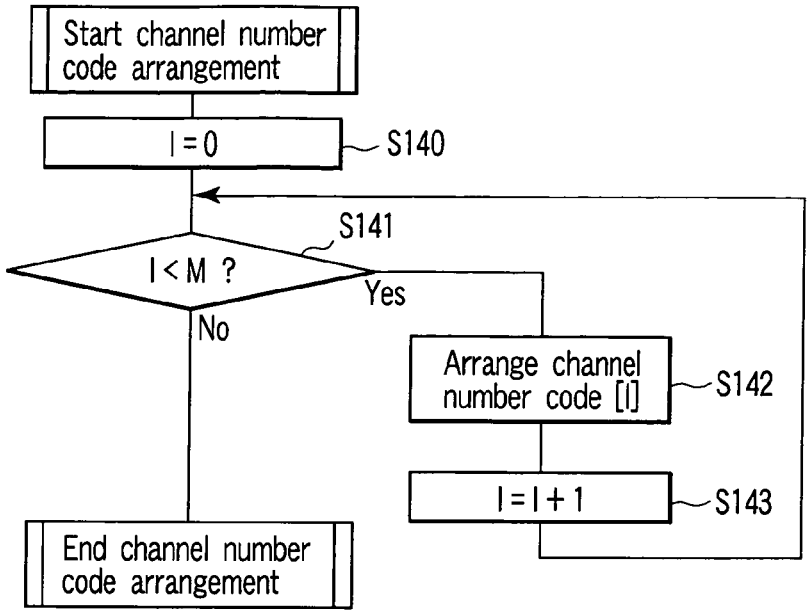
FIG. 22 is a flowchart showing a process relating to channel number code arrangement executed in step S68 of FIG. 13 in further detail.

That is, as shown in the flowchart of FIG. 22 in detail, the code arrangement unit 10 first substitutes 0 into the variable I relating to the track number (step S140), and thereafter judges whether or not this variable I is smaller than the track number M (step S141).

Since I=0 is set in the step S140 in the first loop, the code arrangement unit 10 advances to Yes from the step S141, arranges the channel number code [0] (step S143), and thereafter increments the variable I relating to the track number by one to set I=1 (step S143). Moreover, the code arrangement unit 10 repeats the process of the steps S141 to S143 again, and subsequently arranges channel number code [1]. Additionally, in this example it is assumed that, as shown in FIG. 3, m+1 is set to M relating to the track number. Therefore, when the code arrangement unit 10 repeats the process of the above-described steps S141 to S143, and finally arranges the channel number code [m], the unit ends the channel number code arrangement process, and returns to step S68 of FIG. 13.

Subsequently, the code arrangement unit 10 arranges other information codes (step S69).

Figure 23:
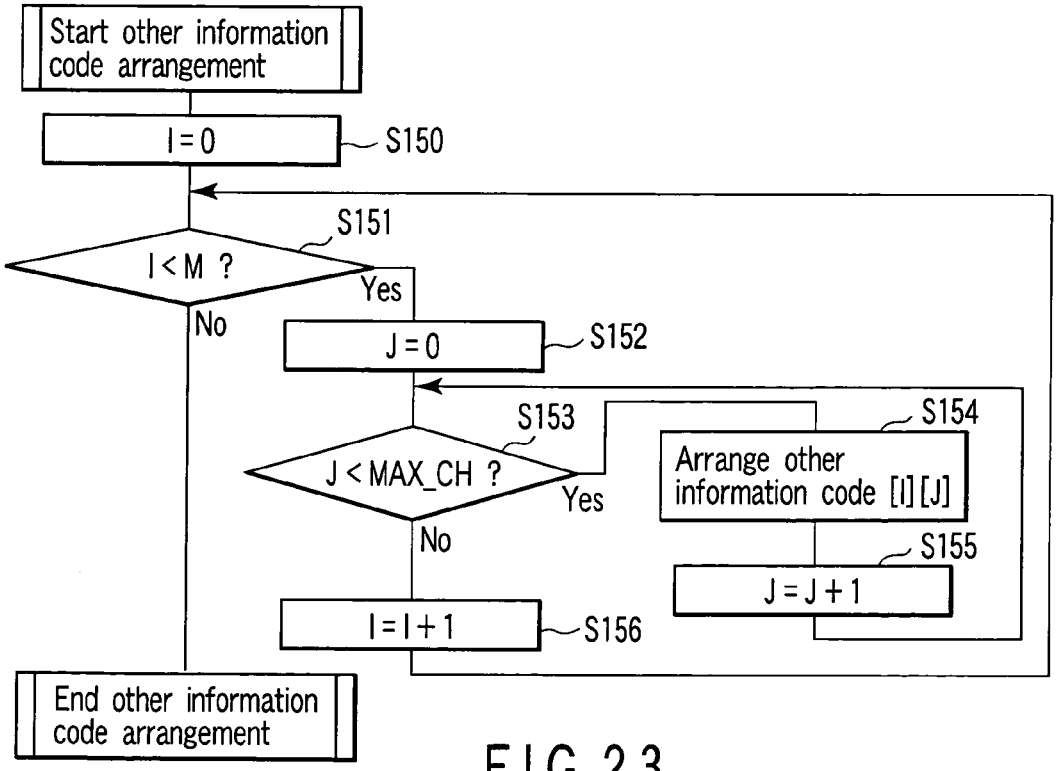
FIG. 23 is a flowchart showing a process relating to another information code arrangement executed in step S69 of FIG. 13 in further detail.

That is, as shown in the flowchart of FIG. 23 in detail, the code arrangement unit 10 first substitutes 0 into the variable I relating to the track number (step S150), and thereafter judges whether or not this variable I is smaller than the track number M (step S151).

Since I=0 is set in the step S150 in the first loop, the code arrangement unit 10 advances to Yes side from the step S151, and substitutes 0 into J relating to the channel number (step S152). Subsequently, the code arrangement unit 10 judges whether or not the variable J relating to this channel number is smaller than the maximum channel number MAX_CH (step S153). Moreover, since J=0 is set in the above-described step S152 in the first loop, the code arrangement unit 10 advances to Yes from the step S153, arranges the other information code [0][0] (step S154), and thereafter increments J relating to the channel number by one to set J=1 (step S155).

Since 16 is set to MAX_CH relating to the maximum channel number beforehand in this embodiment, the code arrangement unit 10 thereafter repeats the process of the steps S153 to S155, and thereafter successively arranges other information code [0][1], other information code [0][2], . . . , other information code [0][15]. Subsequently, after arranging the other information code [0][15], the code arrangement unit 10 advances to No from the step S153, increments the variable I relating to the track number by one to set I=1, thereafter repeats the process of the above-described steps S151 to S155 again, and subsequently successively arranges other information code [1][1], other information code [1][2], . . . , other information code [1][15].

Additionally, in this example, it is assumed that, as shown in FIG. 3, m+1 is set to the track number M. Therefore, when the code arrangement unit 10 repeats the process of the above-described steps S151 to S155, and finally successively arranges other information code [m][1], other information code [m][2], . . . , other information code [m][15] relating to the track m data, the unit ends this other information code arrangement process. Thus, the code arrangement unit 10 ends all the processes relating to the code arrangement.

By the above-described process, the primary code 5 is produced in which codes are arranged in a basic arrangement order shown in FIG. 24. That is, in the example of FIG. 24, in further detail, the basic arrangement order of the primary code 5 is an order of the Δtime code, Note On pitch code, Note Off pitch code, velocity value code, difference bend value code, difference expression value code, event type identification code, channel number code and other information code. Furthermore, as shown in FIG. 25A, the internal arrangement of each code is an order of codes relating to track 0 data (channel number order, this also applies to the following), track 1 data, track m data. An internal arrangement order of the channel number code is as shown in FIG. 25B.

In this primary code 5 itself, wastes are eliminated by the above-described process, additionally musical characteristic of the SMF are not impaired at all, and a considerably compressed data amount is obtained.

Moreover, in the primary codes 5 arranged in this manner, appearance frequency of the same data pattern is higher as compared with the SMF, the same data patterns are disposed adjacent to each other, further a probability that the same data pattern appears in the same type of the code is raised, and the efficiency of the compression by the secondary code production unit 3 described later in detail also rises.

The primary code 5 is input into the secondary code production unit 3, and the secondary code production unit 3 performs compression by a general-purpose compression system. In this example, as the general-purpose compression technique, an LZ coding method, a Huffman coding method, a run length coding method, and further a composite system (e.g., LHA, ZIP, etc.) of them can be adopted.

In further detail, for example, when the use of the LZ coding method is assumed, first, the process is started from the head of the primary code 5, and the data pattern of a process object position is compared with that in a previously processed predetermined range. Moreover, when both the patterns match each other, information such as a distance to the data pattern and length of the matched data pattern is output from the process object position as the secondary code 6. Accordingly, when both the patterns do not match each other, the primary code 5 is output as the secondary code 6 as such.

This series of processes are repeated from the head to the last of the primary code 5.

In this embodiment, the primary code 5 in which each information is disposed in an independent time region for each information type and each channel as described above is prepared, therefore the embodiment is also preferable for the LZ coding method in which the repeated pattern is compressed utilizing repetition of the data pattern, and the compression ratio can be lowered. Furthermore, for example, with respect to the event type identification code, it is also possible to dynamically assign the code in accordance with the appearance frequency of the event type. Therefore, the embodiment is also preferable for the Huffman coding method for coding a weighted code weighted by the appearance frequency of the code for each byte in such a manner that the code can be recorded with the small number of bits, and the compression ratio can be lowered. Additionally, since bias appears in a distribution of values under an SMF format in velocity information, the velocity information is independently integrated and recorded, and accordingly the efficiency of the coding by the Huffman coding method is favorably influenced.

It is to be noted that the adoption of the composite system (LHA) of the LZ method and the Huffman coding is assumed in the embodiment, but in this case, needless to say, both the above-described effects are produced.

(Musical Performance Information Decoding Apparatus, etc.)

Next, a musical performance information decoding apparatus, a musical performance information decoding method, and a musical performance information decoding program according to one embodiment for decoding a primary or secondary code will be described in detail with reference to FIGS. 26 to 47. It is to be noted that a function by the musical performance information decoding apparatus corresponds to the musical performance information decoding method and the musical performance information decoding program.

First, FIG. 26 shows a constitution of the musical performance information decoding apparatus according to one embodiment of the present invention for description. As shown in FIG. 26, a musical performance information decoding apparatus 50 is constituted of a secondary code decoding unit 51 and a primary code decoding unit 52. It is to be noted that the primary code decoding means described in claims corresponds to this primary code decoding unit 52, and secondary code decoding means described in the claims corresponds to this secondary code decoding unit 51 or the like. Additionally, the present invention is not limited to this.

This secondary code decoding unit 51 decodes the above-described secondary code 6 compressed by the above-described general-purpose compression system into a primary code 5. That is, in more detail, the primary code decoding unit 52 decodes the primary code 5 decoded by the secondary code decoding unit 51 into a musical piece file 4 of the above-described format. That is, when the secondary code 6 is decoded into the primary code 5 by the secondary code decoding unit 51, with respect to the above-described primary code 5, the primary code decoding unit 52 extracts each information of each type disposed in an independent region for each type, refers to information indicating attribution to the above-described channel, constitutes each executed information as a plurality of track data attributed to each channel, and further constitutes track data of the file so that the code is decoded into the musical piece file 4.

Here, a detailed constitution of the primary code decoding unit 52 is shown in FIG. 27.

That is, this primary code decoding unit 52 has a channel code extraction unit 53, a track decoding unit 54, a track merge and channel number code decoding unit 55, and a track arrangement unit 56. Constitutions and functions of these respective units 53 to 56 will be described hereinafter in detail.

Figure 28:
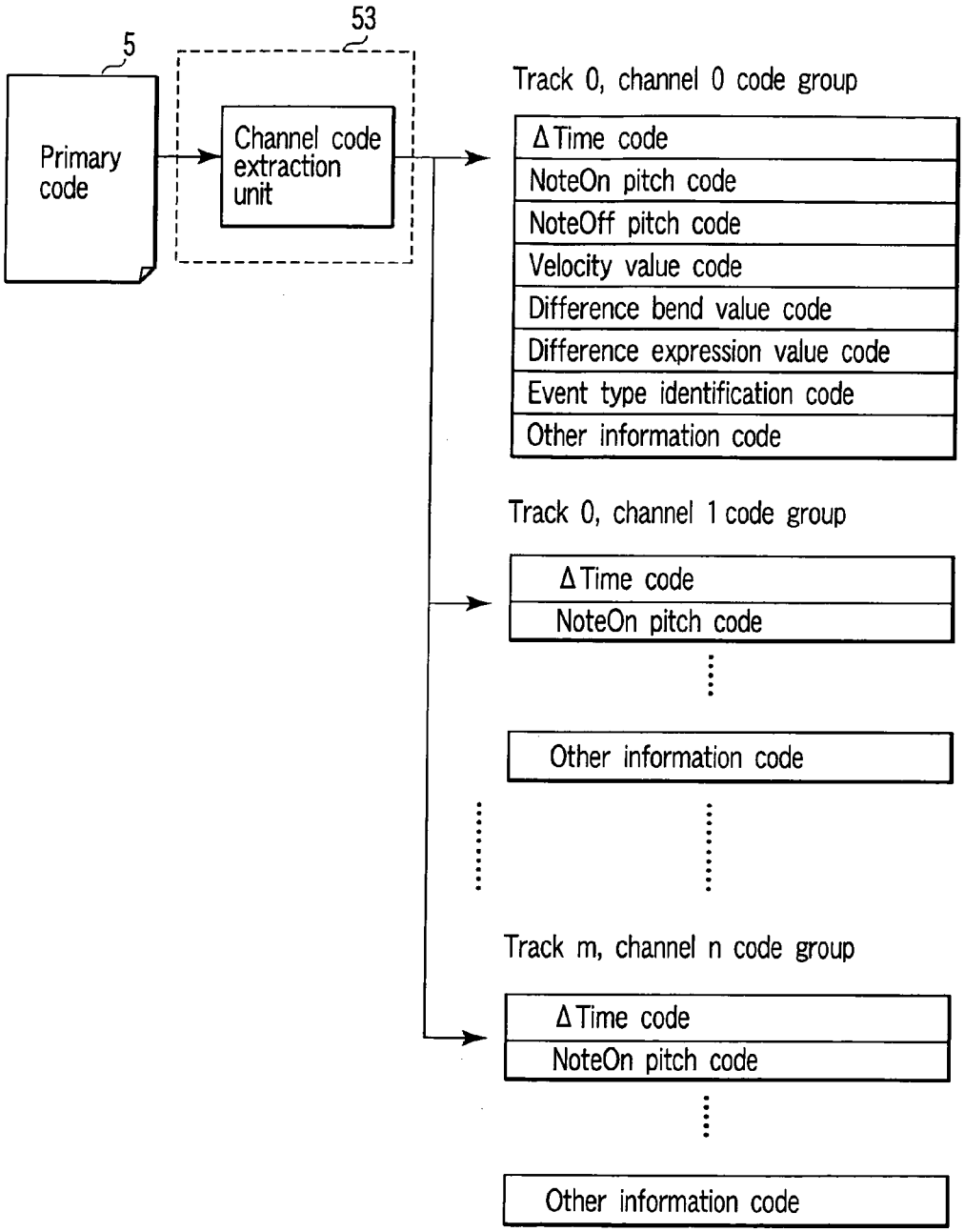
FIG. 28 is a block diagram showing a detailed constitution of a channel code extraction unit 53 in the primary code decoding unit 52 of the musical performance information compression apparatus 1 according to one embodiment.

First, the detailed constitution of the channel code extraction unit 53 is as shown in FIG. 28, and the channel code extraction unit 53 extracts each code included in the primary code 5 by channel. That is, the channel code extraction unit 53 successively extracts a track 0, channel 0 code group, a track 0, channel 1 code group, . . . , a track m, channel n code group by channel. It is to be noted that, needless to say, each code group includes Δtime code, Note On pitch code, Note Off pitch code, velocity value code, difference bend value code, difference expression value code, event type identification code, and other information code.

A flow of a process relating to extraction of codes by channels by the channel code extraction unit 53 will be described hereinafter in detail with reference to a flowchart of FIG. 29.

When the present process starts, first the channel code extraction unit 53 extracts the codes of the header chunk (step S160). The respective codes will be extracted hereinafter.

First, the channel code extraction unit 53 extracts the Δtime code (step S161). That is, as described in a flowchart of FIG. 30 in detail, first the channel code extraction unit 53 substitutes 0 into variable I relating to the track number (step S170), and thereafter judges whether or not this variable I is smaller than the track number M (step S71). Since I=0 is set in the step S170 in a first loop, the channel code extraction unit 53 advances Yes from the step S171, and next substitutes 0 into variable J relating to the channel number (step S172).

Subsequently, the channel code extraction unit 53 judges whether or not the variable J relating to this channel number is smaller than the maximum channel number MAX_CH (step S173).

Moreover, since J=0 is set in the above-described step S172 in the first loop, the channel code extraction unit 53 advances to the Yes side from the step S173, extracts the Δtime code [0][0] (step S174), and increments the variable J relating to the channel number by one to set J=1 (step S175). Since 16 is set to MAX_CH relating to the maximum channel number beforehand in the first embodiment, the channel code extraction unit 53 thereafter repeats the process of the above-described steps S173 to S175, and successively extracts Δtime code [0][1], Δtime code [0][2], . . . , Δtime code [0][15]. After extracting the Δtime code [0][15], the channel code extraction unit 53 advances to No side from the step S173, increments the variable I relating to the track number by one, thereafter repeats the process of the steps S171 to S175, and successively extracts Δtime code [1][1], Δtime code [1][2], . . . , Δtime code [1][15].

Additionally, in the first embodiment, as shown in FIG. 3, it is assumed that m+1 is set to the track number M.

Figure 29:
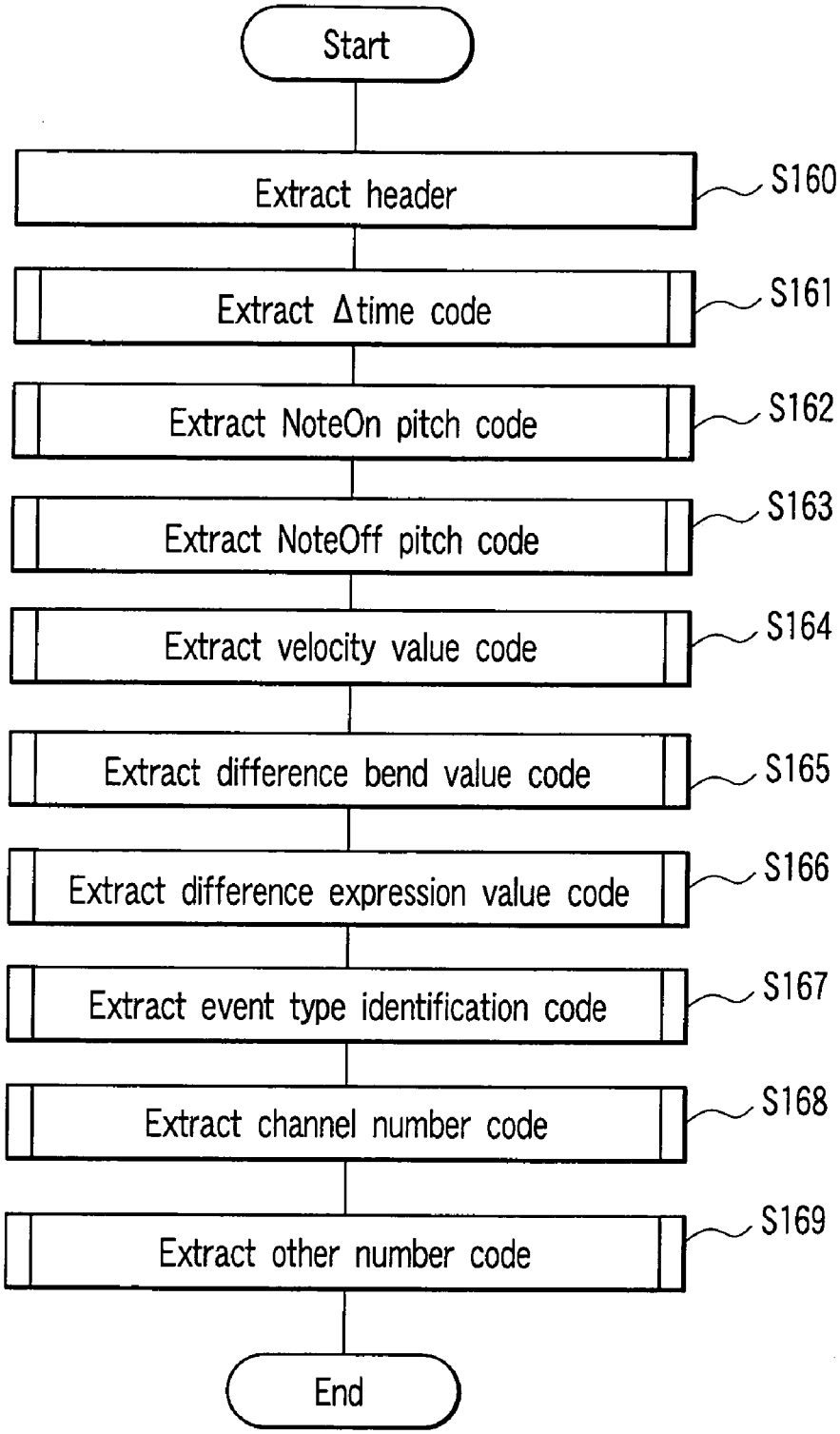
FIG. 29 is a flowchart showing a process relating to code extraction by the channel code extraction unit 53.
Figure 30:
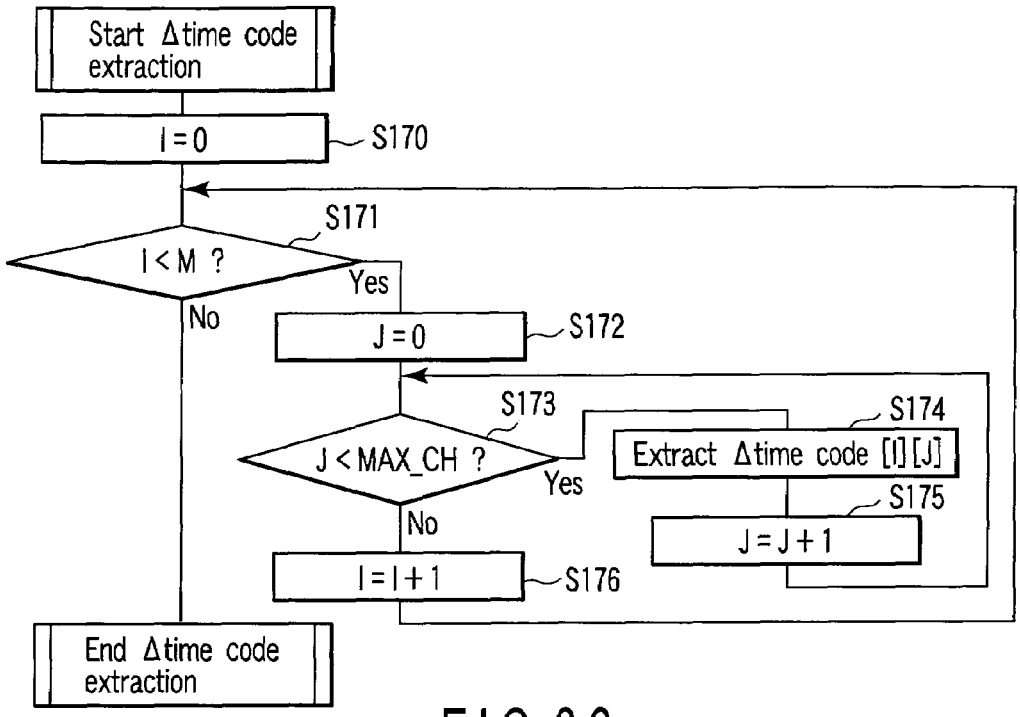
FIG. 30 is a flowchart showing a process relating to Δtime code extraction executed in step S161 of FIG. 29 in further detail.

Therefore, when the channel code extraction unit 53 repeats the process of the above-described steps S171 to S175, and finally successively extracts Δtime code [m][1], Δtime code [m][2], . . . , Δtime code [m][15] relating to the track m data, the unit ends this Δtime code extraction process, and returns to the step S161 of FIG. 29.

Figure 31:
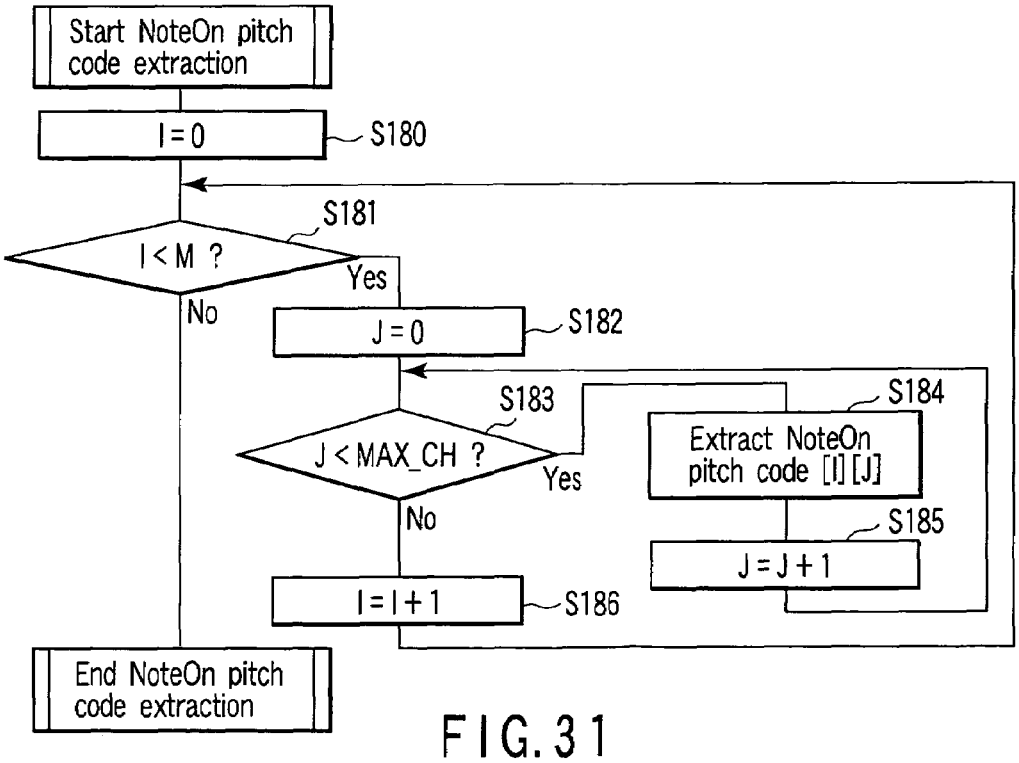
FIG. 31 is a flowchart showing a process relating to Note On pitch code extraction executed in step S162 of FIG. 29 in further detail.

Subsequently, the channel code extraction unit 53 extracts the Note On pitch code (step S162). That is, as shown in the flowchart of FIG. 31 in detail, the channel code extraction unit 53 first substitutes 0 into the variable I relating to the track number (step S180), and thereafter judges whether or not this variable I is smaller than the track number M (step S181). First, since I=0 is set in the step S180 in the first loop, the channel code extraction unit 53 advances to Yes from the step S181, and next substitutes 0 into J relating to the channel number (step S182).

Subsequently, the channel code extraction unit 53 judges whether or not the variable J relating to this channel number is smaller than the maximum channel number MAX_CH (step S183).

Since J=0 is set in the above-described step S182 in the first loop, the channel code extraction unit 53 advances to the Yes side from the step S183, extracts the Note On pitch code [0][0] (step S184), and thereafter increments the variable J relating to the channel number by one to set J=1 (step S185).

Since 16 is set to the maximum channel number MAX_CH beforehand in this embodiment, the channel code extraction unit 53 thereafter repeats the process of the above-described steps S183 to S185, and successively extracts Note On pitch code [0][1], Note On pitch code [0][2], . . . , Note On pitch code [0][15]. After extracting the Note On pitch code [0][15], the channel code extraction unit 53 advances to No from the step S183, increments the variable I relating to the track number by one to set I=1, thereafter repeats the process of the steps S181 to S185 again, and subsequently successively extracts Note On pitch code [1][1], Note On pitch code [1][2], . . . , Note On pitch code [1][15].

Additionally, in this example, as shown in FIG. 3, it is assumed that m+1 is set to M relating to the track number. Therefore, when the channel code extraction unit 53 repeats the process of the above-described steps S181 to S185, and finally successively extracts Note On pitch code [m][1], Note On pitch code [m][2], . . . , Note On pitch code [m][15] relating to the track m data, the unit ends this Note On pitch code extraction process, and returns to the step S162 of FIG. 29.

Figure 32:
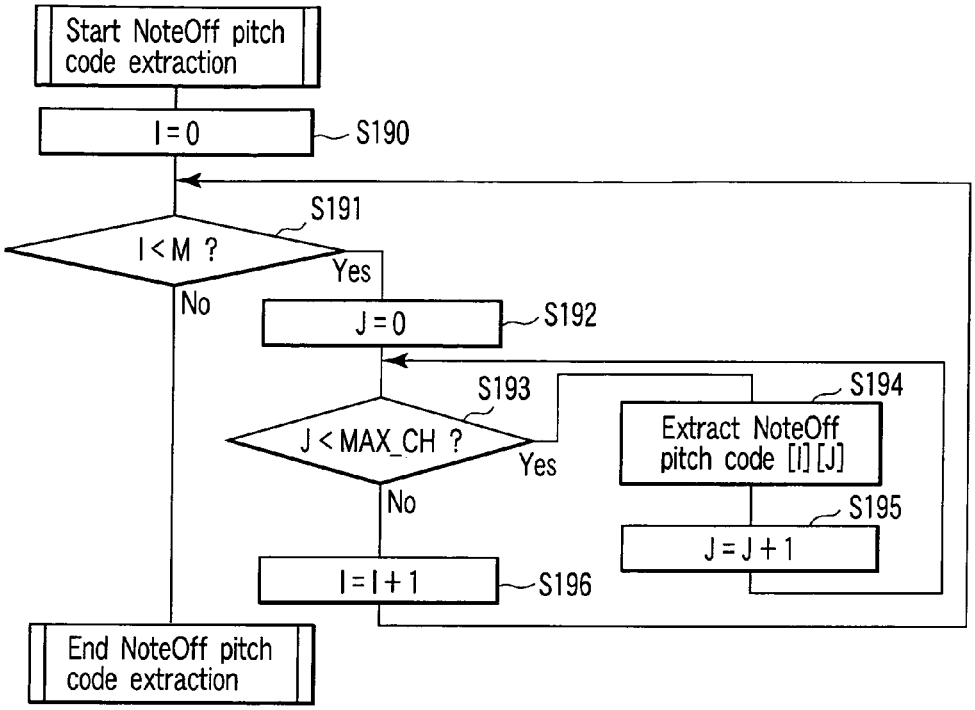
FIG. 32 is a flowchart showing a process relating to Note Off pitch code extraction executed in step S163 of FIG. 29 in further detail.

Subsequently, the channel code extraction unit 53 extracts Note Off pitch codes (step S163). That is, as shown in the flowchart of FIG. 32 in detail, the channel code extraction unit 53 first substitutes 0 into the variable I relating to the track number (step S190), and thereafter judges whether or not this variable I is smaller than the track number M (step S191). Since I=0 is set in the step S190 in the first loop, the channel code extraction unit 53 advances to Yes from the step S191, and next substitutes 0 into the variable J relating to the channel number (step S192).

Subsequently, the channel code extraction unit 53 judges whether or not the variable J relating to this channel number is smaller than the maximum channel number MAX_CH (step S193).

Since J=0 is set in the above-described step S192 in the first loop, the channel code extraction unit 53 advances to Yes from the step S193, extracts the Note Off pitch code [0][0] (step S194), and increments variable J relating to the channel number by one to set J=1 (step S195).

In this embodiment, since 16 is set to MAX_CH relating to the maximum channel number beforehand, the channel code extraction unit 53 subsequently repeats the process of the above-described steps S193 to S195, and successively extracts Note Off pitch code [0][1], Note Off pitch code [0][2], . . . , Note Off pitch code [0][15].

Subsequently, after extracting the Note Off pitch code [0][15], the channel code extraction unit 53 advances to the No side from the step S193, increments variable I relating to the track number by one to set I=1, thereafter repeats the process of the steps S191 to S195 again, and subsequently successively extracts Note Off pitch code [1][1], Note Off pitch code [1][2], . . . , Note Off pitch code [1][15].

Additionally, in this example, as shown in FIG. 3, it is assumed that m+1 is set to M relating to the track number. Therefore, when the channel code extraction unit 53 repeats the process of the above-described steps S191 to S195, and finally successively extracts Note Off pitch code [m][1], Note Off pitch code [m][2], . . . , Note Off-pitch code [m][15] relating to the track m data, the unit ends this Note Off pitch code extraction process, and returns to the step S163 of FIG. 29.

Figure 33:
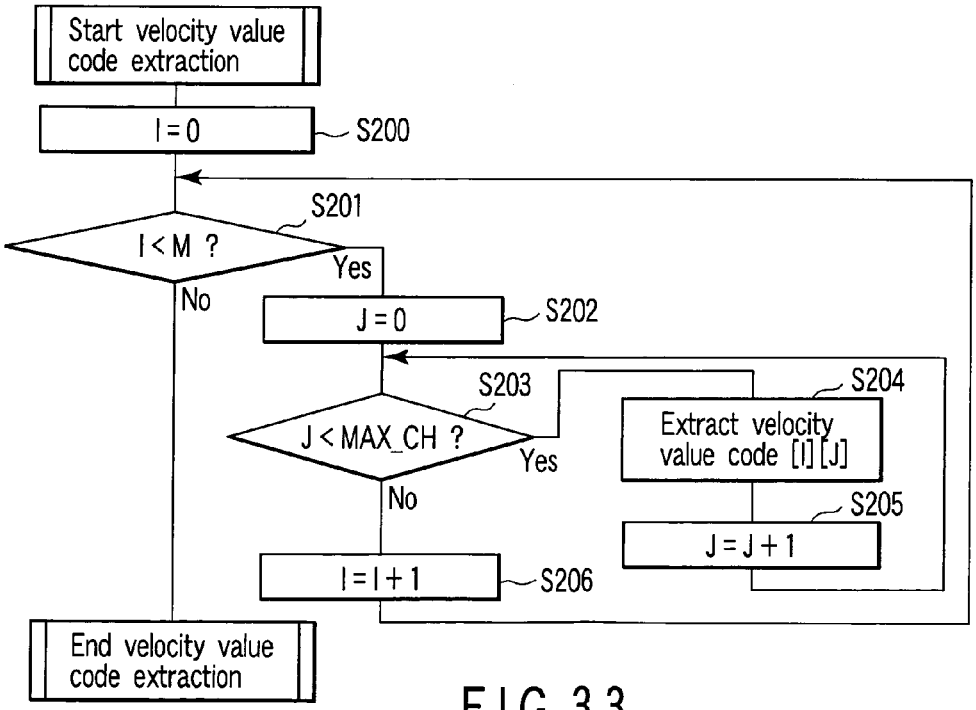
FIG. 33 is a flowchart showing a process relating to velocity value code extraction executed in step S164 of FIG. 29 in further detail.

Subsequently, the channel code extraction unit 53 extracts a velocity value code (step S164). That is, as shown in the flowchart of FIG. 33 in detail, the channel code extraction unit 53 first substitutes 0 into the variable I relating to the track number (step S200), and thereafter judges whether or not this variable I is smaller than the track number M (step S201). First, since I=0 is set in the step S200 in the first loop, the channel code extraction unit 53 advances to Yes from the step S201, and subsequently substitutes 0 into variable J relating to the channel number (step S202).

Subsequently, the channel code extraction unit 53 judges whether or not the variable J relating to this channel number is smaller than the maximum channel number MAX_CH (step S203).

Moreover, since J=0 is set in the step S202 in the first loop, the channel code extraction unit 53 advances to the Yes side from the step S203, extracts the velocity value code [0][0] (step S204), and thereafter increments J relating to the channel number by one to set J=1 (step S205).

Since 16 is set to MAX_CH relating to the maximum channel number beforehand in this embodiment, the channel code extraction unit 53 thereafter repeats the process of the above-described steps S203 to S205, and successively extracts velocity value code [0][1], velocity value code [0][2], . . . , velocity value code [0][15].

Subsequently, after extracting the velocity value code [0][15], the channel code extraction unit 53 advances to the No side from the step S203, increments I relating to the track number by one to set I=1, thereafter repeats the process of the steps S201 to S205 again, and subsequently successively extracts velocity value code [1][1], velocity value code [1][2], . . . , velocity value code [1][15].

Additionally, in this example, as shown in FIG. 3, it is assumed that m+1 is set to M relating to the track number. Therefore, when the channel code extraction unit 53 repeats the process of the above-described steps S201 to S205, and finally successively extracts velocity value code [m][1], velocity value code [m][2], . . . , velocity value code [m][15] relating to the track m data, the unit ends this velocity value code extraction process, and returns to the step S164 of FIG. 29.

Subsequently, a difference bend value code is extracted (step S165).

Figure 34:
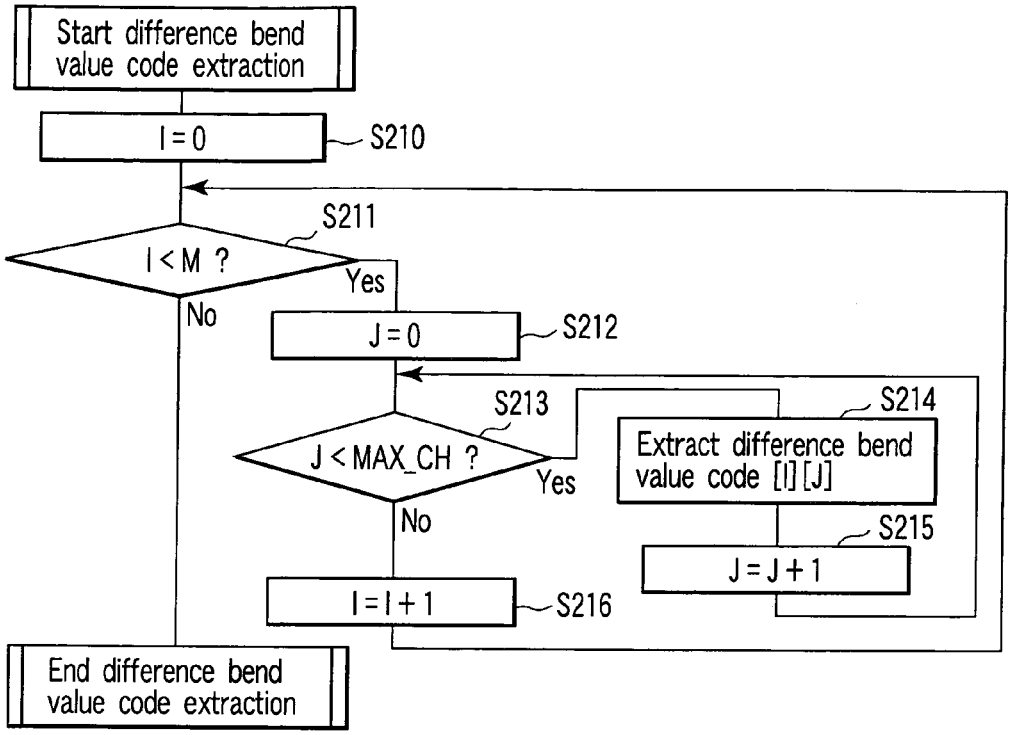
FIG. 34 is a flowchart showing a process relating to difference bend value code extraction executed in step S165 of FIG. 29 in further detail.

That is, as shown in the flowchart of FIG. 34 in detail, the channel code extraction unit 53 substitutes 0 into the variable I relating to the track number (step S210), and thereafter judges whether or not this variable I is smaller than the track number M (step S211).

Since I=0 is set in the step S210 in the first loop, the channel code extraction unit 53 advances to Yes side from the step S211, and next substitutes 0 into J relating to the channel number (step S212). Subsequently, the channel code extraction unit 53 judges whether or not the variable J relating to this channel number is smaller than the maximum channel number MAX_CH (step S213). Since J=0 is set in the above-described step S212 in the first loop, the channel code extraction unit 53 advances to Yes side from the step S213, extracts the difference bend value code [0][0] (step S214), and thereafter increments the variable J relating to the channel number by one (step S215).

In this embodiment, since 16 is set to MAX_CH relating to the maximum channel number beforehand, the channel code extraction unit 53 thereafter repeats the process of the above-described steps S213 to S215, and successively extracts difference bend value code [0][1], difference bend value code [0][2], . . . , difference bend value code [0][15].

Moreover, after extracting the difference bend value code [0][15], the channel code extraction unit 53 advances to the No side from the step S213, increments I relating to the track number by one to set I=1, thereafter repeats the process of the steps S211 to S215 again, and subsequently successively extracts difference bend value code [1][1], difference bend value code [1][2], . . . , difference bend value code [1][15].

Additionally, in this example, it is assumed that, as shown in FIG. 3, m+1 is set to M relating to the track number. Therefore, when the channel code extraction unit 53 repeats the process of the above-described steps S211 to S215, and finally successively extracts difference bend value code [m][1], difference bend value code [m][2], . . . , difference bend value code [m][15] relating to the track m data, the unit ends this difference bend value code extraction process, and returns to the step S165 of FIG. 29.

Figure 35:
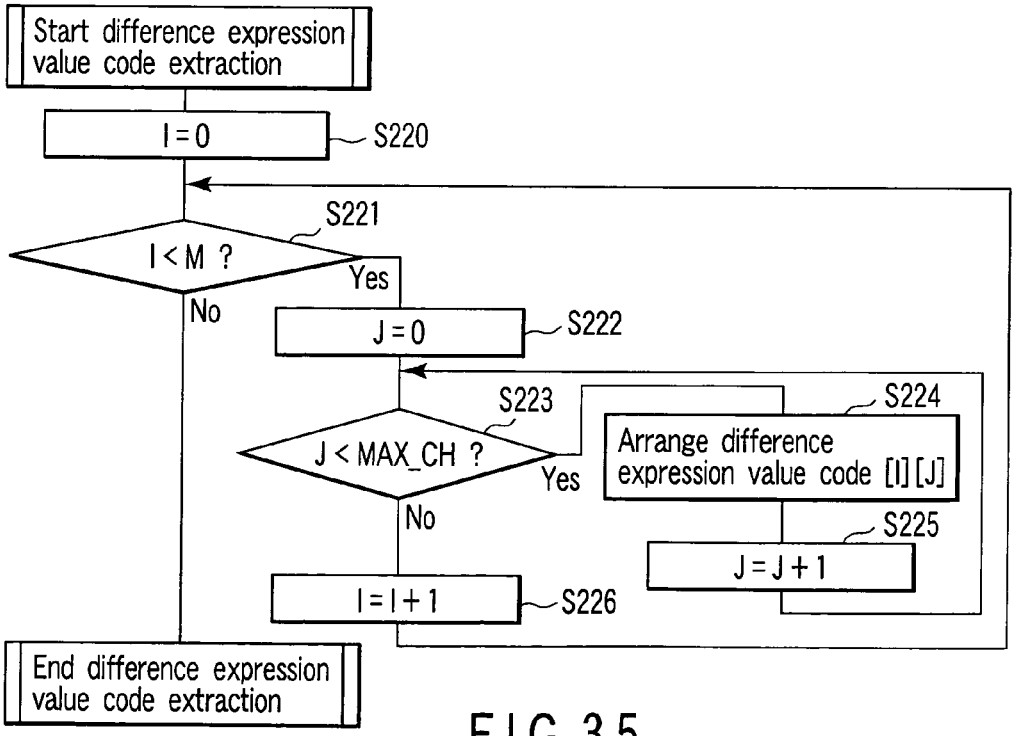
FIG. 35 is a flowchart showing a process relating to difference expression value code extraction executed in step S166 of FIG. 29 in further detail.

Subsequently, the channel code extraction unit 53 extracts difference expression value codes (step S166). That is, as shown in the flowchart of FIG. 35 in detail, the channel code extraction unit 53 substitutes 0 into the variable I relating to the track number (step S220), and thereafter judges whether or not this I is smaller than the track number M (step S221). Since I=0 is set in the above-described step S220 in the first loop, the channel code extraction unit 53 advances to Yes from the step S221, and next substitutes 0 into the variable J relating to the channel number (step S222).

Subsequently, the channel code extraction unit 53 judges whether or not the variable J relating to this channel number is smaller than the maximum channel number MAX_CH (step S223).

Since J=0 is set in the above-described step S222 in the first loop, the channel code extraction unit 53 advances to Yes from the step S223, extracts the difference expression value code [0][0] (step S224), and thereafter increments J relating to the channel number by one to set J=1 (step S225).

Since 16 is set to MAX_CH relating to the maximum channel number beforehand in the first embodiment, the channel code extraction unit 53 thereafter repeats the process of the above-described steps S223 to S225, and successively extracts difference expression value code [0][1], difference expression value code [0][2], difference expression value code [0][15]. Moreover, after extracting the difference expression value code [0][15], the channel code extraction unit 53 advances to No from the step S123, increments the variable I relating to the track number by one to set I=1, thereafter repeats the process of the steps S221 to S225, and subsequently successively extracts difference expression value code [1][1], difference expression value code [1][2], . . . , difference expression value code [1][15]. Additionally, in this example, it is assumed that, as shown in FIG. 3, m+1 is set to the track number M.

Therefore, the channel code extraction unit 53 repeats the process of the above-described steps S221 to S225, and finally successively extracts difference expression value code [m][1], difference expression value code [m][2], . . . , difference expression value code [m][15] relating to the track m data, the unit ends this difference expression value code extraction process, and returns to the step S166 of FIG. 29.

Figure 36:
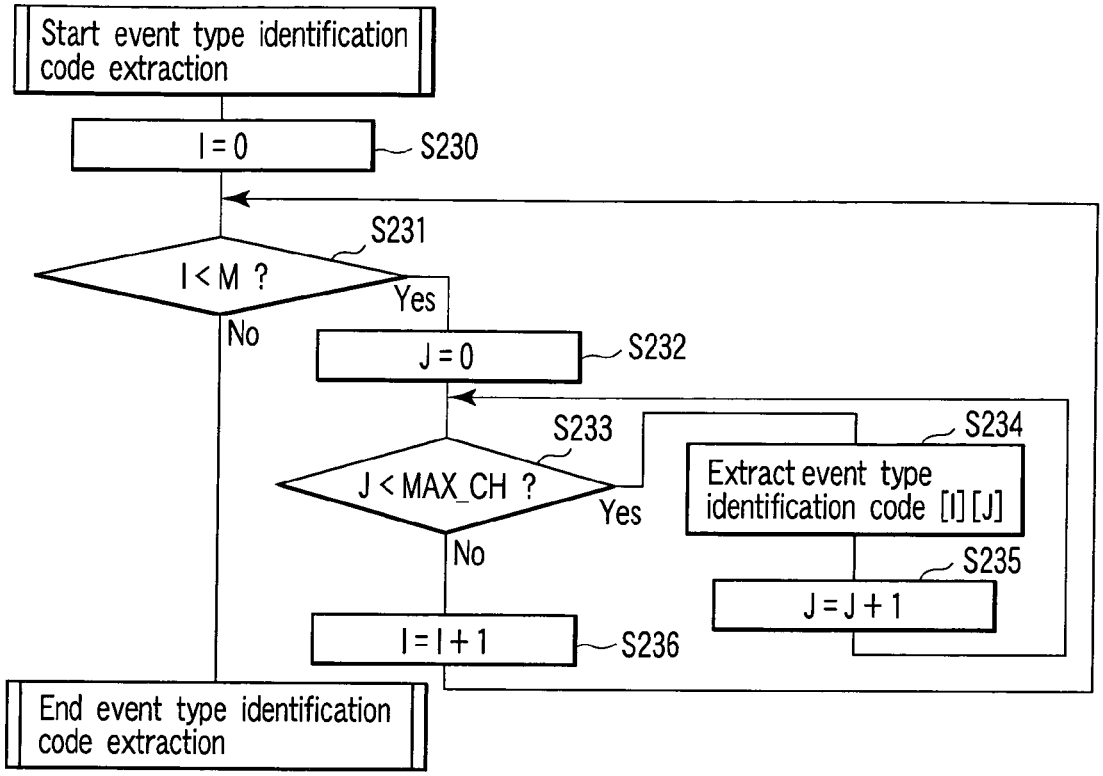
FIG. 36 is a flowchart showing a process relating to event type identification code extraction executed in step S167 of FIG. 29 in further detail.

Subsequently, the channel code extraction unit 53 extracts an event type identification code (step S167). That is, as shown in the flowchart of FIG. 36 in detail, the channel code extraction unit 53 first substitutes 0 into the variable I relating to the track number (step S230), and thereafter judges whether or not this variable I is smaller than the track number M (step S231). First, since I=0 is set in the step S230 in the first loop, the channel code extraction unit 53 advances to Yes from the step S231, and next substitutes 0 into the variable J relating to the channel number (step S232).

Subsequently, the channel code extraction unit 53 judges whether or not the variable J relating to this channel number is smaller than MAX_CH relating to the maximum channel number (step S233).

Moreover, since J=0 is set in the step S232 in the first loop, the channel code extraction unit 53 advances to Yes from the step S233, extracts the event type identification code [0][0] (step S234), and thereafter increments J relating to the channel number by one to set J=1 (step S235).

Since 16 is set to MAX_CH relating to the maximum channel number beforehand in this embodiment, the channel code extraction unit 53 thereafter repeats the process of the steps S233 to S235, and successively extracts event type identification code [0][1], event type identification code [0][2], . . . , event type identification code [0][15].

Subsequently, after extracting the event type identification code [0][15], the channel code extraction unit 53 advances to the No side from the step S233, increments I relating to the track number by one to set I=1, thereafter repeats the process of the above-described steps S231 to S235 again, and subsequently successively extracts event type identification code [1][1], event type identification code [1][2], . . . , event type identification code [1][15].

Additionally, in this embodiment, it is assumed that, as shown in FIG. 3, m+1 is set to M relating to the track number. Therefore, when the channel code extraction unit 53 repeats the process of the above-described steps S231 to S235, and finally successively extracts event type identification code [m][1], event type identification code [m][2], . . . , event type identification code [m][15] relating to the track m data, the unit ends the event type identification code extraction process, and returns to the step S167 of FIG. 29.

Figure 37:
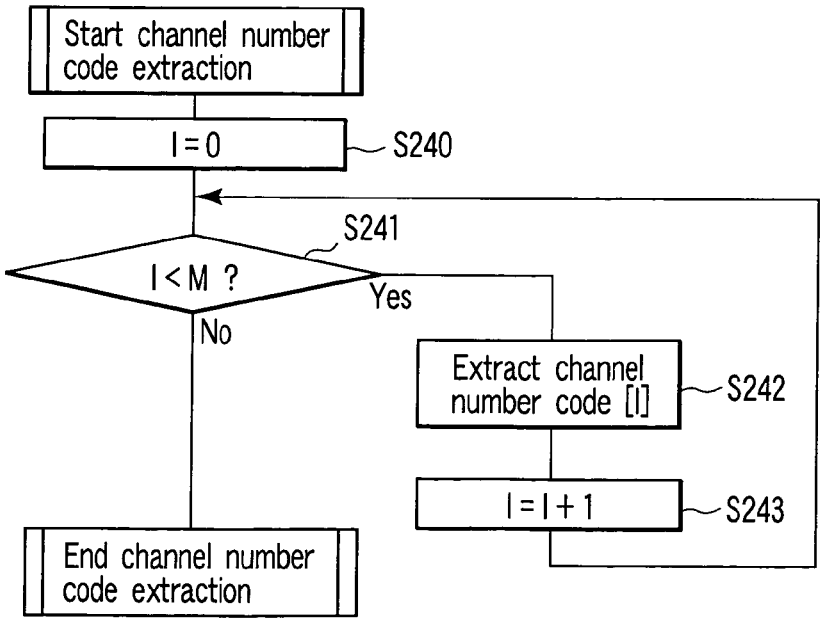
FIG. 37 is a flowchart showing a process relating to channel number code extraction executed in step S168 of FIG. 29 in further detail.

Subsequently, the channel code extraction unit 53 extracts a channel number code (step S168). That is, as shown in the flowchart of FIG. 37 in detail, the channel code extraction unit 53 first substitutes 0 into the variable I relating to the track number (step S240), and thereafter judges whether or not this variable I is smaller than the track number M (step S241). Moreover, since I=0 is set in the above-described step S240 in the first loop, the channel code extraction unit 53 branches to Yes from the step S241, extracts the channel number code [0] (step S242), and thereafter increments the variable J relating to the track number by one to set I=1 (step S243).

Moreover, the channel code extraction unit 53 repeats the process of the steps S241 to S243 again, and subsequently extracts channel number code [1].

In this example it is assumed that, as shown in FIG. 3, m+1 is set to M relating to the track number. Therefore, when the channel code extraction unit 53 repeats the process of the above-described steps S241 to S243, and finally extracts the channel number code [m] relating to the track m data, the unit ends this channel number code extraction process, and returns to step S168 of FIG. 29.

Figure 38:
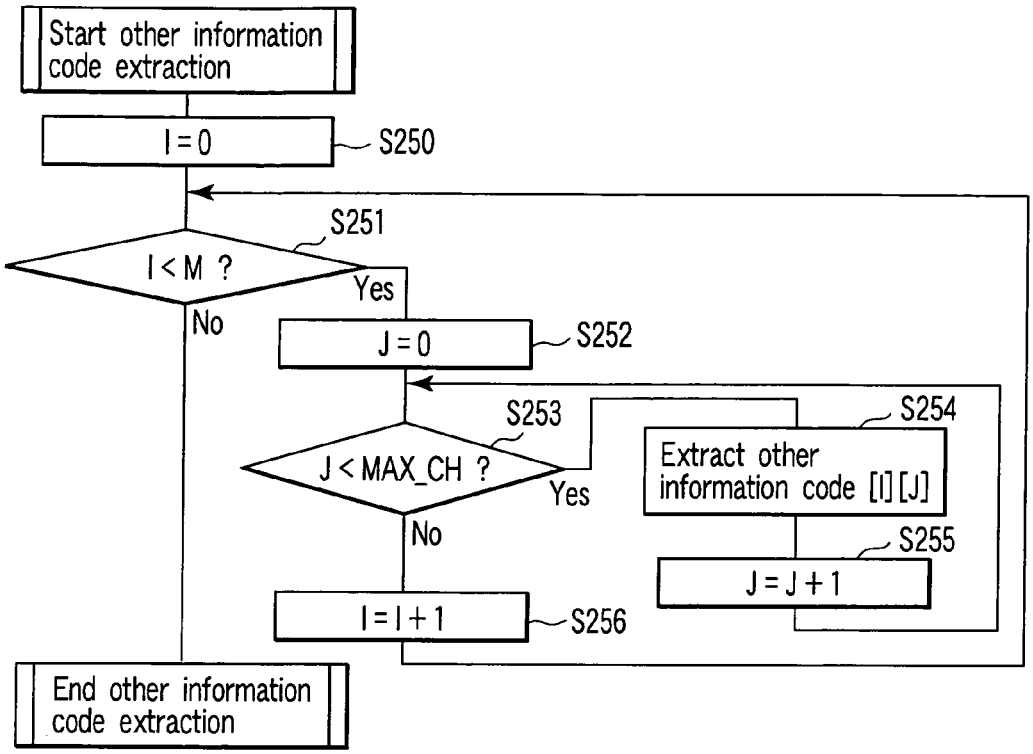
FIG. 38 is a flowchart showing a process relating to another information code extraction executed in step S169 of FIG. 29.

Subsequently, the channel code extraction unit 53 extracts other information codes (step S169). That is, as shown in the flowchart of FIG. 38 in detail, the channel code extraction unit 53 first substitutes 0 into the variable I relating to the track number (step S250), and thereafter judges whether or not this variable I is smaller than the track number M (step S251). Since I=0 is set in the step S150 in the first loop, the channel code extraction unit 53 advances to Yes from the step S251, and next substitutes 0 into variable J relating to the channel number (step S252).

Subsequently, the channel code extraction unit 53 judges whether or not the variable J relating to this channel number is smaller than the maximum channel number MAX_CH (step S253).

Moreover, since J=0 is set in the step S252 in the first loop, the channel code extraction unit 53 advances to Yes from the step S253, extracts the other information code [0][0] (step S254), and thereafter increments J relating to the channel number by one to set J=1 (step S255).

Since 16 is set to MAX_CH relating to the maximum channel number beforehand in this embodiment, the channel code extraction unit 53 thereafter repeats the process of the steps S253 to S255, and thereafter successively arranges other information code [0][1], other information code [0][2], . . . , other information code [0][15].

Subsequently, after extracting the other information code [0][15], the channel code extraction unit 53 advances to No from the step S253, increments the variable I relating to the track number by one, thereafter repeats the process of the steps S251 to S255 again, and subsequently successively extracts other information code [1][1], other information code [1][2], . . . , other information code [1][15]. Additionally, in this example, it is assumed that, as shown in FIG. 3, m+1 is set to M relating to the track number.

Therefore, when the channel code extraction unit 53 repeats the process of the above-described steps S251 to S255, and finally successively extracts other information code [m][1], other information code [m][2], . . . , other information code [m][15] relating to the track m data, the unit ends this other information code extraction process. Thus, a series of processes relating to the code extraction by channel by the channel code extraction unit 53 are ended. By the above-described processes, the code group constituted of a single channel (each code group including the Δtime code, Note On pitch code, Note Off pitch code, velocity value code, difference bend value code, difference expression value code, event type identification code, and other information code) is executed.

Figure 39:
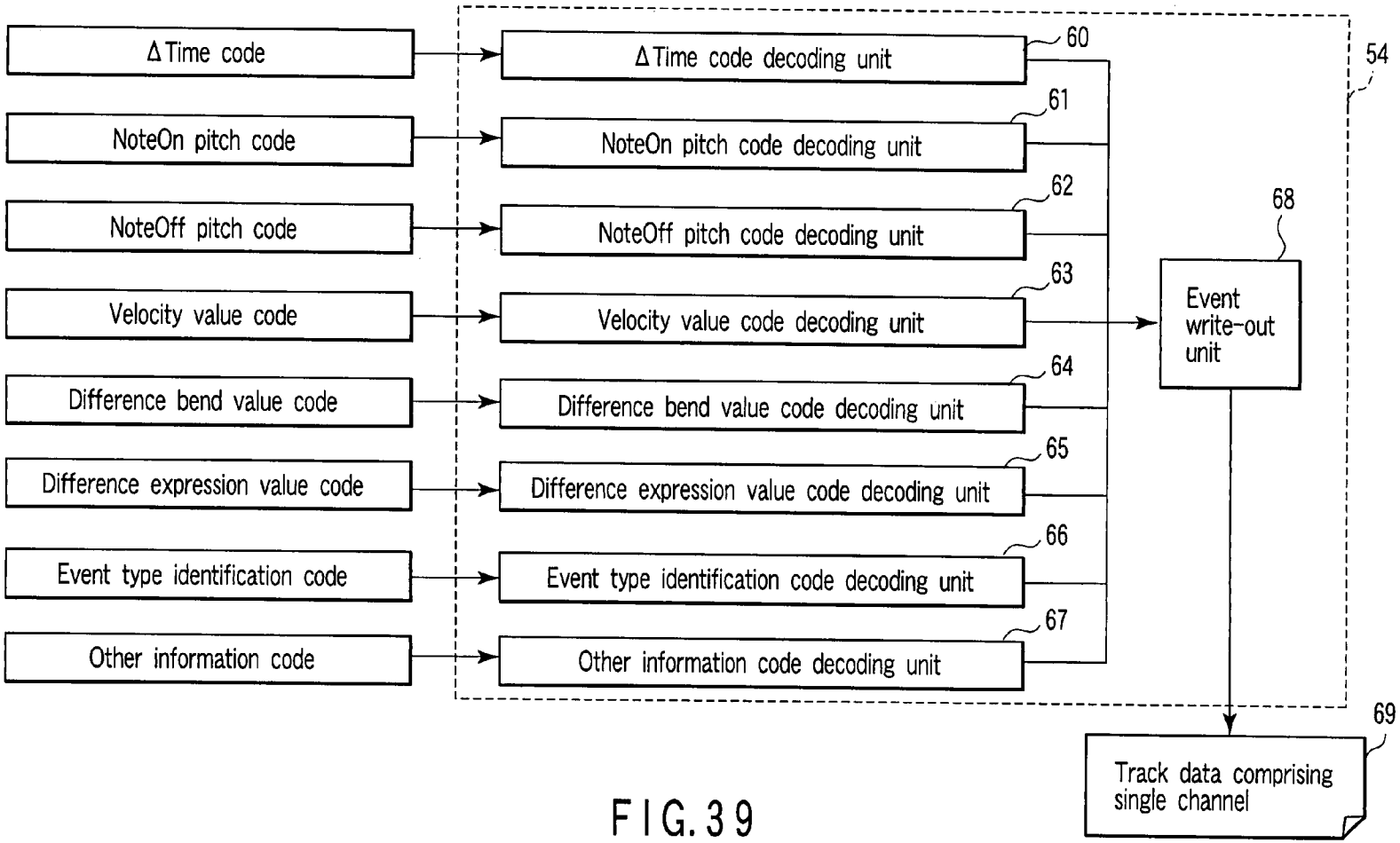
FIG. 39 is a block diagram showing a detailed constitution of a track decoding unit 54 in a primary code decoding unit 52 of the musical performance information compression apparatus 50 according to one embodiment.

Next, a detailed constitution of the track decoding unit 54 is as shown in FIG. 39.

The track decoding unit 54 has a Δtime code decoding unit 60, a Note On pitch code decoding unit 61, a Note Off pitch code decoding unit 62, a velocity value code decoding unit 63, a difference bend value code decoding unit 64, a difference expression value code decoding unit 65, an event type identification code decoding unit 66, an other information code decoding unit 67, and an event write-out unit 68. These respective units 60 to 67 decode the respective codes, the event write-out unit 68 executes write-out of the event with respect to each corresponding code, and thus track data 69 constituted of a single channel is produced.

Figure 40:
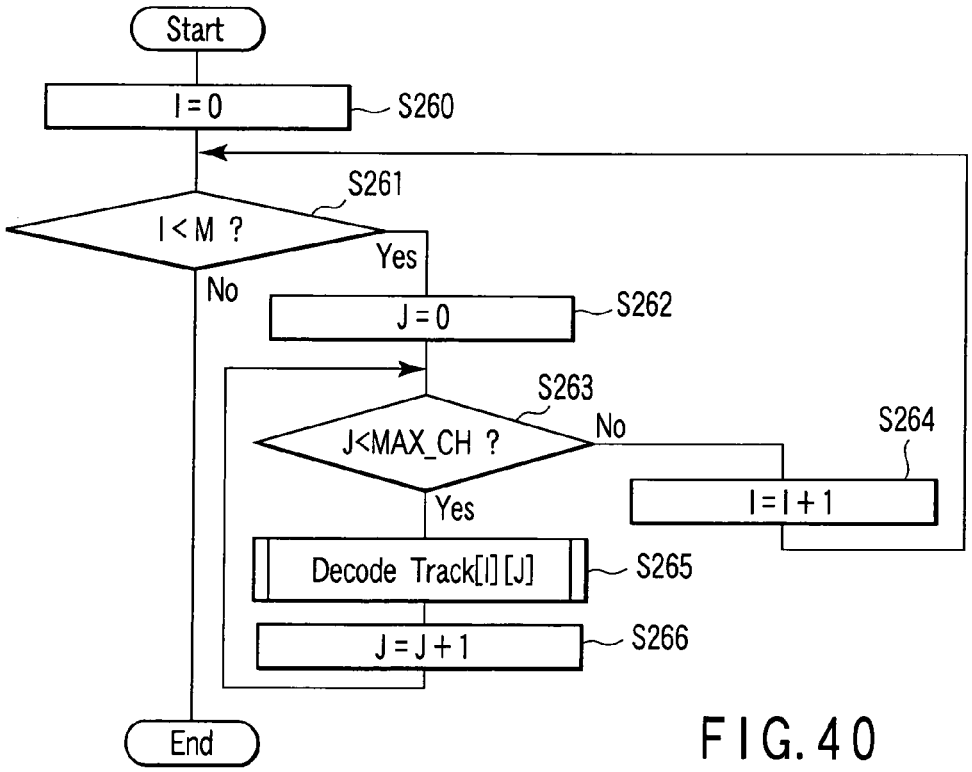
FIG. 40 is a flowchart showing a decoding process by the track decoding unit 54.

A flow of a process relating to track decoding by the track decoding unit 54 will be described hereinafter with reference to a flowchart of FIG. 40 in detail.

When this process starts, the track decoding unit 54 first substitutes 0 into variable I relating to the track number (step S260), and compares the variable I relating to this track number with the track number M (step S261). Moreover, when the track decoding unit 54 judges that a relation of I<M is established, the unit substitutes 0 into variable J relating to the channel number (step S262), and judges whether or not J relating to the channel number is smaller than the maximum channel number MAX_CH (step S263).

Moreover, since J=0 is set in the step S262 beforehand in the first loop, the track decoding unit 54 judges that a relation of J<MAX_CH is satisfied, and executes decoding with respect to track 0 data of channel 0 only stored in Track[0][0] (step S265). Moreover, the track decoding unit 54 increments the variable J relating to the channel number by one to set J=1, and thereafter repeats the process of the above-described steps S263 to 266 (step S266).

Since MAX_CH=16 is predetermined in this embodiment, the track decoding unit 54 decodes track 0 data of channel 0 only, track 0 data of channel 1 only, . . . , track 0 data of channel 15 only, stored in Track[0][0], Track[0][1], . . . , Track[0][15], respectively. Subsequently, the track decoding unit 54 increments track number I by one, and thereafter successively decodes track 1 data of channel 0 only, track 1 data of channel 1 only, . . . , track 1 data of channel 15 only, stored in Track[1][0], Track[1][1], . . . , Track[1][15], respectively (steps S261 to S266).

Subsequently, when the track decoding unit 54 decodes track m data of channel 0 only, track m data of channel 1 only, . . . , track m data of channel 15 only, stored in Track[m][0], Track[m][1], . . . , Track[m][15], respectively (steps S261 to S266), the present process ends.

Figure 41:
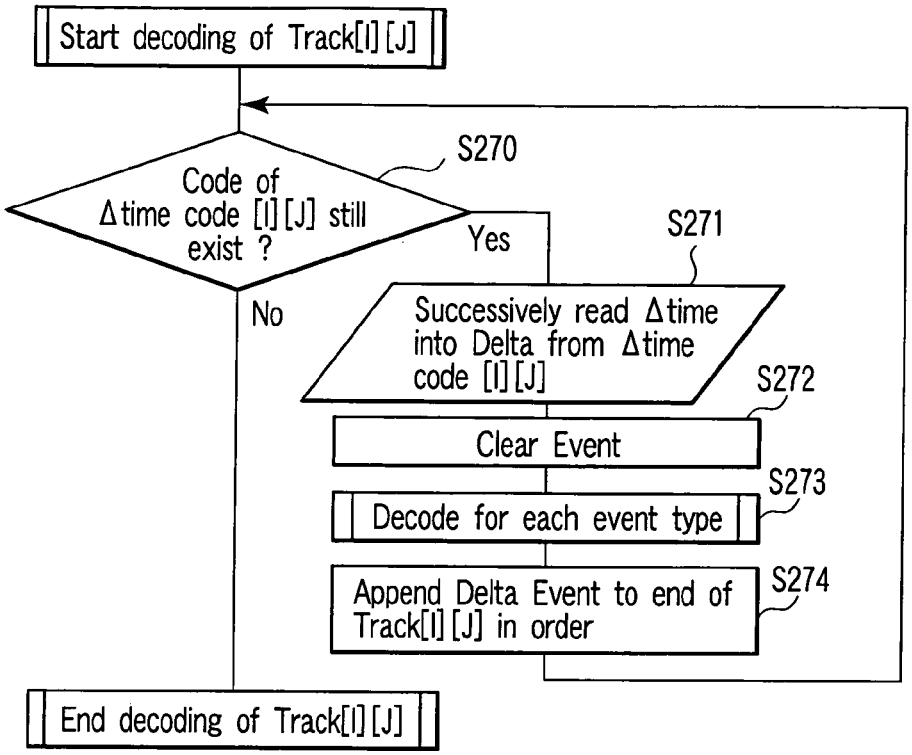
FIG. 41 is a flowchart showing a process relating to decoding of Track[I][J] executed in step S265 of FIG. 40 in further detail.

Here, the process relating to the decoding of Track[I][J] performed by the track decoding unit 54 in the step S265 of FIG. 40 will be described with reference to a flowchart of FIG. 41 in further detail. That is, when this process starts, the track decoding unit 54 first judges whether or not any code exists in Δtime code [I][J] (step S270).

When the track decoding unit 54 judges in this step S270 that the code exists in the Δtime code [I][J], the unit reads Δtime from the Δtime code [I][J], stores the Δtime in variable Delta (step S271), clears the variable Event (step S272), and executes the decoding for each event type as described later in detail (step S273). Thus, the track decoding unit 54 adds Δtime relating to variable Delta, and event relating to variable Event to the end of Track[I][J] in this order, and returns to the above-described step S270 (step S274).

The track decoding unit 54 repeats the above-described process as long as the code exists in the delta time code [I][J], decodes all the codes, then advances to No from the step S270, and ends this process.

Figure 42A:
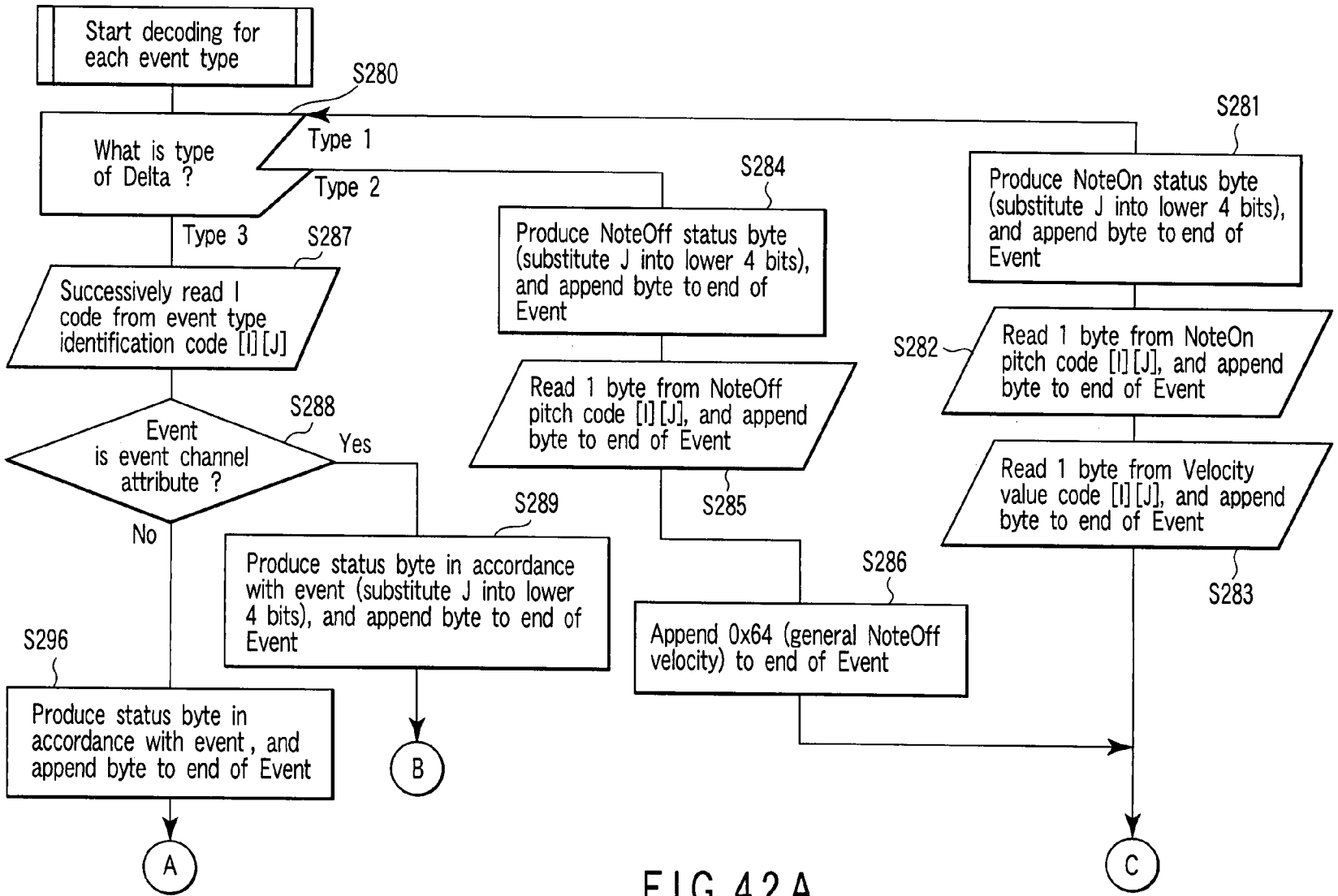
FIGS. 42A, 42B are flowcharts showing a process relating to decoding by each event type executed in step S273 of FIG. 41 in further detail.
Figure 42B:
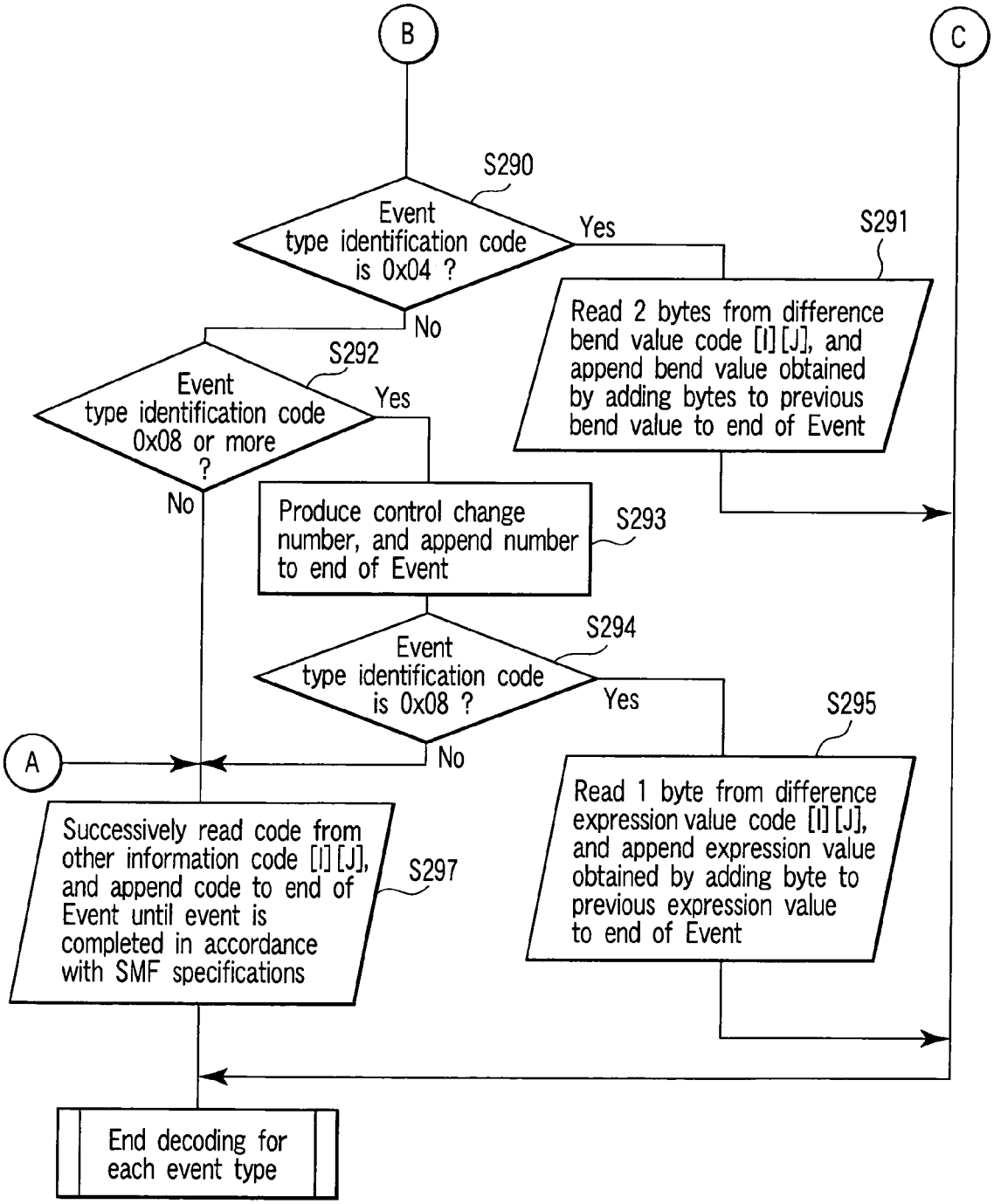

Next, a process relating to the decoding for each event type performed by the track decoding unit 54 in the step S273 of FIG. 41 will be described in further detail with reference to flowcharts of FIGS. 42A, 42B. That is, when this process starts, the track decoding unit 54 judges the type of the event from Δtime stored in variable Delta (step S280).

As described above, in the first embodiment, the type of the event can be identified by information of a head byte of the Δtime. In more detail, in this example, event types can be identified as three types, that is, note-on (type 1), note-off (type 2), and others (type 3).

When the track decoding unit 54 judges that the event is of the type 1, that is, Note On in the above-described S280, the unit produces Note On status byte (substitutes J in lower four bits in this example) to add the byte to the end of variable Event (step S281), reads the code of one byte from Note On pitch code [I][J] to add the code to the end of the variable Event (step S282), and reads the code of one byte from the velocity value code [I][J] to add the code to the end of the variable Event (step S283).

On the other hand, when the track decoding unit 54 judges that the event is of the type 2, that is, Note Off in the above-described S280, the unit produces Note Off status byte (substitutes J in the lower four bits in this example) to add the byte to the end of variable Event (step S284), reads the code of one byte from the Note On pitch code [I][J] to add the code to the end of the variable Event (step S285), and adds a code of a general Note Off velocity value to the end of the variable Event (step S286).

On the other hand, when the track decoding unit 54 judges that the event is of the type 3, that is, other event in the above-described step S280, the unit successively reads one code from event type identification code [I][J] (step S287), and subsequently judges whether or not the event belongs to the channel (step S288).

Here, when the track decoding unit 54 judges that the event belongs to the channel, the unit produces the status byte in accordance with the event (J is substituted into the lower four bits) to add the byte to the end of the variable Event (step S289).

Subsequently, the track decoding unit 54 judges whether or not the event type identification code is 0x04 (see FIG. 21) (step S290). When the track decoding unit 54 judges that the event type identification code is 0x04 in this step S290, it is seen from a table of FIG. 21 that the event is a pitch bend change. Therefore, the unit reads the code of two bytes from the difference bend value code [I][J], and adds a bend value obtained by adding the code to the previous bend value to the end of the variable Event (step S291).

On the other hand, when the track decoding unit 54 judges that the event type identification code is not 0x04 (see FIG. 21) in the above-described step S290, the unit next judges whether or not the code is not less than 0x08 (see FIG. 21) (step S292).

Moreover, when the track decoding unit 54 judges that the event type identification code is 0x08 or more in this step S292, it is recognized from the table of FIG. 21 that the control change number is an event relating to the omitted control change, and therefore the unit produces the control change number to add the number to the end of the variable Event (step S293).

Next, the track decoding unit 54 judges whether or not the event type identification code is 0x08 (see FIG. 21) (step S294).

When it is judged in this step S294 that the code is 0x08, it is seen from the table of FIG. 21 that the corresponding event is expression, and therefore the unit reads the code of one byte from the difference expression value code [I][J], and adds an expression value obtained by adding the value to the previous expression value to the end of the variable Event (step S295). On the other hand, when the unit judges in the above-described step S292 that the event type identification code is not 0x08 or more, and when the unit judges in the above-described step S294 that the code is not 0x08, the track decoding unit 54 successively reads the code from other information code [I][J] to add the code to the end of the variable Event in accordance with a format of SMF described in the beginning until the event is completed (step S297).

On the other hand, when the track decoding unit 54 judges in the above-described step S288 that the event does not belong to the channel, the unit produces the status byte in accordance with the event to add the byte to the end of Event (step S296), and shifts to the above-described step S297. Thus, the track decoding unit 54 ends a series of processes relating to the decoding for each event type.

Figure 43:
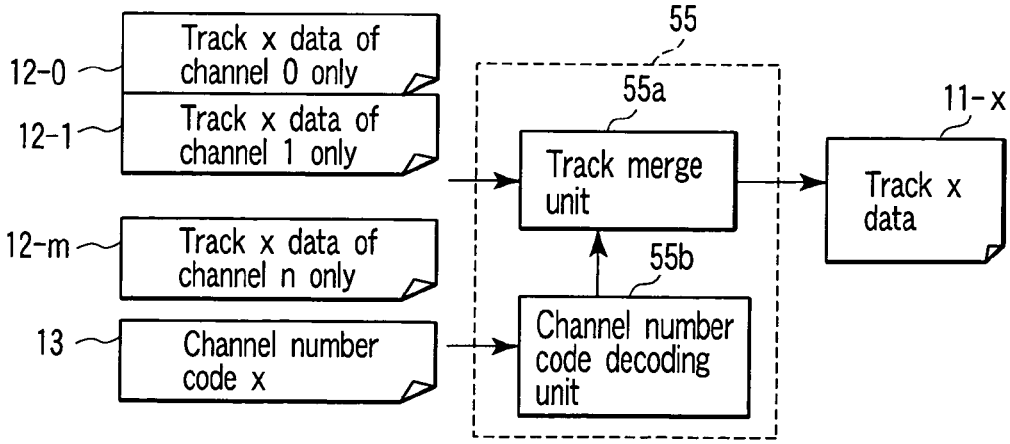
FIG. 43 is a block diagram showing a detailed constitution of a track merge and channel number code deciding unit 55 in the primary code decoding unit 52 of the musical performance information compression apparatus 50 according to one embodiment.

Next, a detailed constitution of the track merge and channel number code decoding unit 55 is as shown in FIG. 43. As shown in the figure, the unit is constituted of a track merge unit 55*a* and a channel number code decoding unit 55*b*. Moreover, when track x data of channel 0 only, track x data of channel 1 only, . . . , track x data of channel n only, and channel number code X are input into the track merge and channel number code decoding unit 55 under this constitution, the channel number code decoding unit 55*b* decodes a channel number code 13. Moreover, the track merge unit 55*a* considers the corresponding channel number code while decoding track x data 11-*x*. At this time, the event which does not belong to the channel is stored as an event belonging to a predetermined channel (e.g., channel 0) as described in the coding, and is therefore decoded in the same manner as in the event which belongs to the usual channel.

Figure 44:
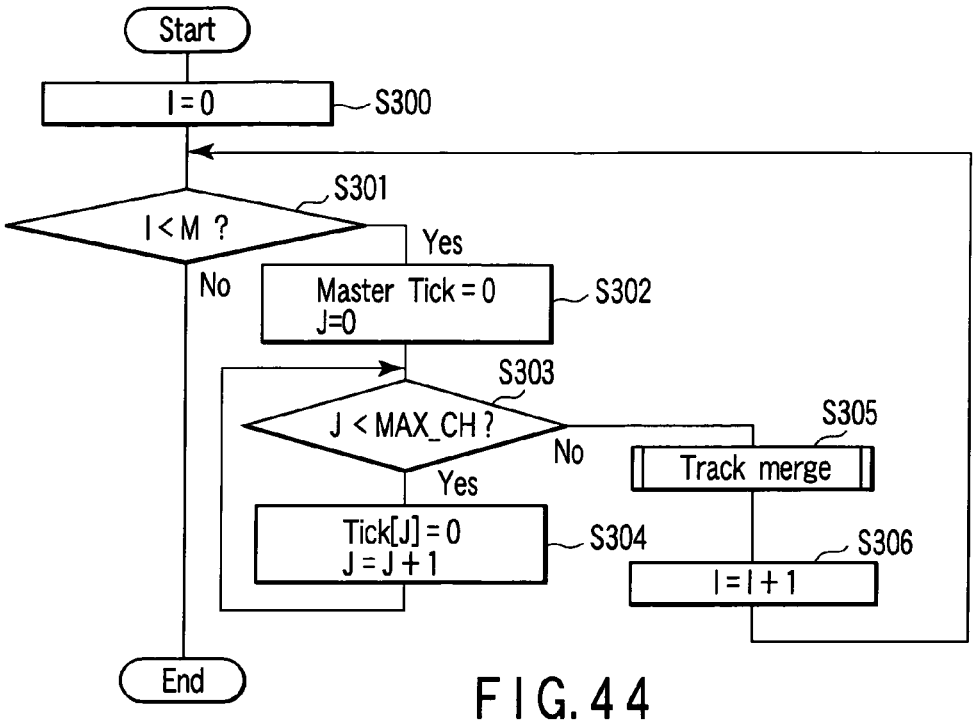
FIG. 44 is a flowchart showing a process relating to the decoding of a track merge and channel number code by the track merge and channel number code deciding unit 55.

A flow of a process relating to the decoding by the track merge and channel number code decoding unit 55 will be described hereinafter with reference to a flowchart of FIG. 44.

When the present process starts, the track merge and channel number code decoding unit 55 first substitutes 0 into I relating to the track number (step S300), and compares the variable I relating to this track number with the track number M (step S301).

Moreover, when the track merge and channel number code decoding unit 55 judges that a relation of I<M is established, 0 is substituted into variable MasterTick and variable J relating to the channel number (step S302). This variable MasterTick means an elapsed time (tick) in the present compounding position of the track in which an event group belonging to a plurality of decoded channels is stored in track decoding at the time of the compounding.

Subsequently, the track merge and channel number code decoding unit 55 judges whether or not the variable J relating to the corresponding channel number is smaller than the maximum channel number MAX_CH (step S303). Since J=0 is set in the step S302 in the first loop, the track merge and channel number code decoding unit 55 judges that a relation of J<MAX_CH is established, sets 0 to Tick[0], further increments variable J relating to the channel number to set J=1 (step S304), and returns to the above-described step S303. This Tick[x] means an elapsed time in the present pursuit position of the track in which the event belonging to the channel J is stored. Since each track has an independent time axis, this arrangement is required.

Since MAX_CH=16 is predetermined in this example, the track merge and channel number code decoding unit 55 executes the above-described process with respect to Tick[0], Tick[1], . . . , Tick[15]. After this process, the track merge and channel number code decoding unit 55 performs the process of track merge described later in detail (step S305), increments the variable I by one to set I=1 (step S306), repeats the process of the above-described steps S301 to S306, and thus decodes the track 1 data, track 2 data, track x, . . . , track m data.

Figure 45:
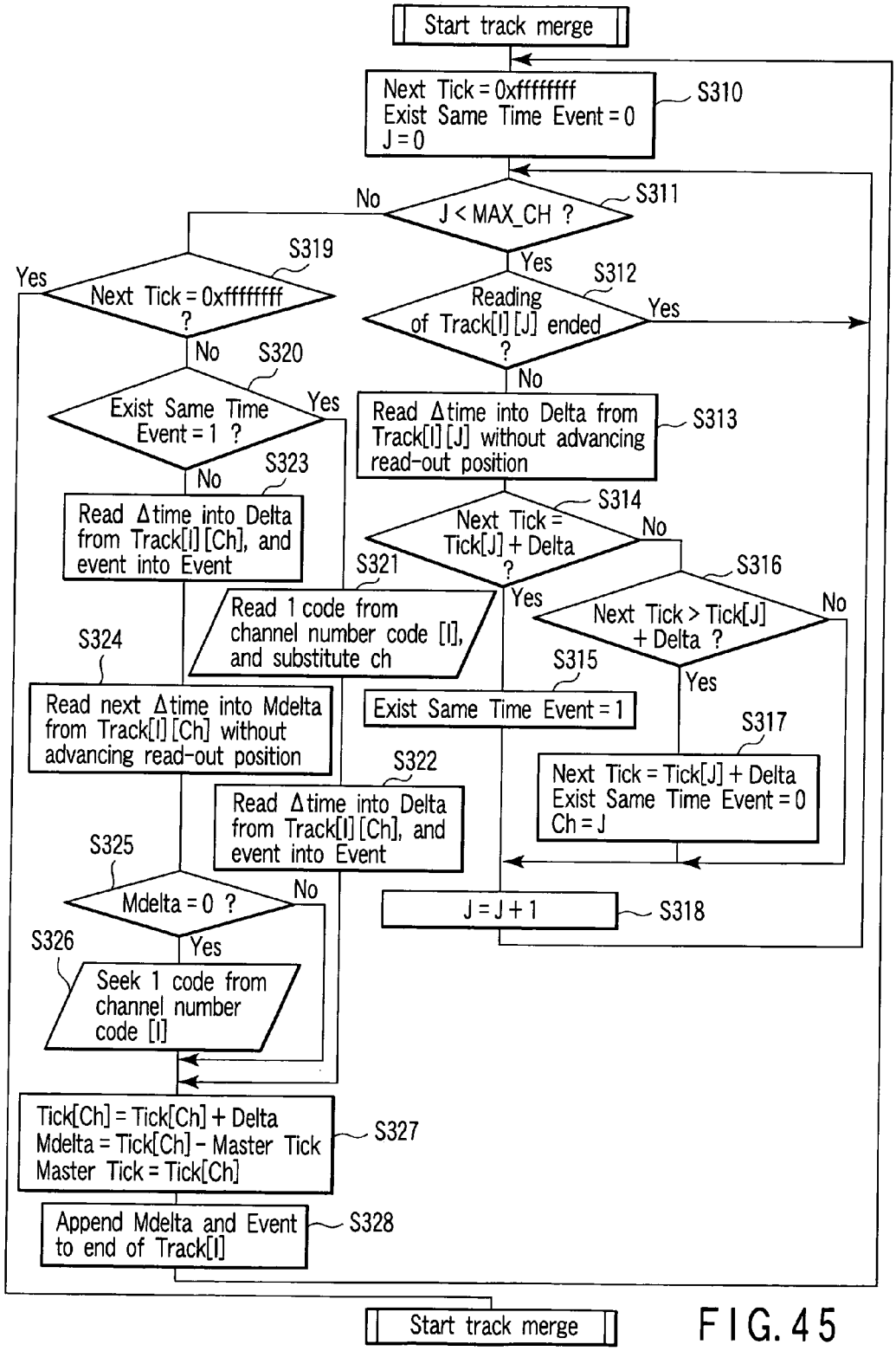
FIG. 45 is a flowchart showing a process relating to track merge executed in step S305 of FIG. 44 in further detail.

Here, a process relating to the track merge by the track merge and channel number code decoding unit 55 (including track merge unit 55*a*, channel number code decoding unit 55*b*) in the step S305 of FIG. 44 will be described in further detail with reference to a flowchart of FIG. 45. When this process starts, the track merge and channel number code decoding unit 55 initializes values NextTick, ExistSameTimeEvent, variable J for use in this process (step S310), and compares this variable J with the maximum channel number MAX_CH (step S311). Since 0 is set to the variable J in the step S310 in the first loop, the track merge and channel number code decoding unit 55 advances to the Yes side from this step S311, and subsequently judges whether or not the reading of Track[I][0] has ended (step S312).

Here, since the reading of Track[I][0] does not end, the track merge and channel number code decoding unit 55 advances to the No side from step S312, reads Δtime from track data of Track[I][0] without advancing the read-out position, and stores the Δtime in variable Delta (step S313). Subsequently, the track merge and channel number code decoding unit 55 judges whether or not NextTick=Tick[J]+Delta (step S314). When NextTick=Tick[J]+Delta, ExistSameTimeEvent=1 is set (step S315). When NextTick=Tick[J]+Delta is not set, it is judged whether or not NextTick>Tick[J]+Delta (step S316).

When this relation is established, the track merge and channel number code decoding unit 55 sets NextTick=Tick[J]+Delta, ExistSameTimeEvent=0, Ch=J (step S317), and thereafter increments the variable J by one to set J=1 (step S318). Moreover, the track merge and channel number code decoding unit 55 repeats the above-described process of the steps S311 to S318 with respect to Track[I][0], Track[I][1], . . . , Track[I][15].

When the track merge and channel number code decoding unit 55 advances to No from the above-described step S311, the unit judges whether or not NextTick=0xffffffff (step S319). When the unit judges that a relation of NextTick=0xffffffff is not established, the unit judges whether or not ExistSameTimeEvent=1 (step S320).

Moreover, when the track merge and channel number code decoding unit 55 judges that ExistSameTimeEvent=1 in the above-described step S320, the unit reads one code from the channel number code [I], substitutes the code into Ch (step S321), and further reads Δtime into Delta and event into Event from Track[I][Ch] (step S322). On the other hand, when the track merge and channel number code decoding unit 55 judges that ExistSameTimeEvent=0 in the step S320, the unit reads Δtime into Delta and event into Event from Track[I][Ch] (step S323), reads the next Δtime into Mdelta from Track[I][Ch] without advancing the read-out position (step S324), and judges whether or not Mdelta=0 (step S325).

Moreover, here, when Mdelta=0, the track merge and channel number code decoding unit 55 searches seek 1 code from channel number code [I] (step S326). Next, the track merge and channel number code decoding unit 55 updates Tick relating to the track data of the channel into which the event is read, calculates Δtime to be coded into Mdelta, and further updates MasterTick (step S327). Moreover, the unit adds the Δtime substituted into Mdelta and the event substituted into Event to the end of Track[I] (step S328), returns to the above-described step S310, and repeats the above-described process. Moreover, when the track merge and channel number code decoding unit 55 judges in the above-described step S319 that a relation of NextTick=0xffffffff is established, the unit ends this process. Thus, track 0 data, track 1 data, . . . , track m data for each track are produced.

They are input into the track arrangement unit 56, track-arranged in the track arrangement unit 56, and thus decoded into the musical piece file 4.

Figure 47:
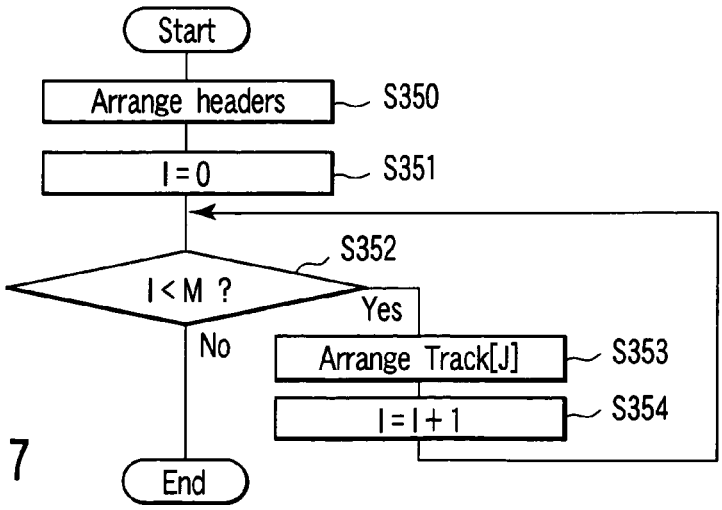
FIG. 47 is a flowchart showing a process relating to track arrangement by the track arrangement unit 56.

A process relating to the track arrangement by the track arrangement unit 56 will be described hereinafter in detail with reference to a flowchart of FIG. 47. That is, when this process is started, the track arrangement unit 56 first arranges header chunk (step S350), subsequently initializes I relating to the track number into 0 (step S351), and compares the variable I relating to this track number with the track number M (step S352). Moreover, when a relation of I<M is established, the track arrangement unit 56 arranges the track 0 data stored in the Track[0] (step S353), increments I relating to the track number to set I=1, and thereafter repeats the process of the above-described steps S352 to S354.

Figure 46:
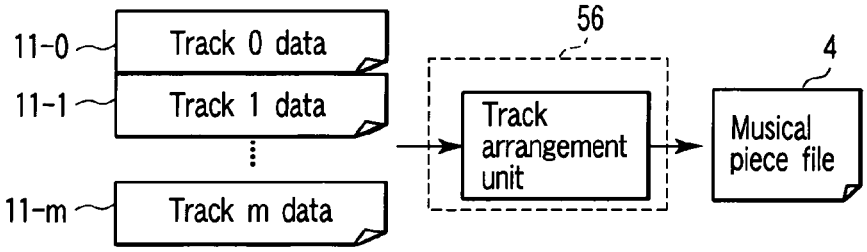
FIG. 46 is a block diagram showing a detailed constitution of a track arrangement unit 56 in the primary code decoding unit 52 in the musical performance information compression apparatus 50 according to one embodiment.

In the first embodiment, since M=m+1 in a relation with FIG. 46, the track arrangement unit 56 arranges the track 0 data, track 1 data, . . . , track m data stored Track[0], Track[1], . . . , Track[m] (steps S352 to S354), and thus ends the present process.

By the above-described series of processes, the primary code 5 is decoded from the secondary code 6 by the secondary code decoding unit 51, and the musical piece file 4 is decoded from the primary code 5 by the primary code decoding unit 52. Thus decoded musical piece file 4 completely matches original musical performance information without changing the order of the respective musical performance information.

As described above, the musical performance information compression apparatus, the musical performance information compression method, the musical performance information compression program, the musical performance information decoding apparatus, the musical performance information decoding method, and the musical performance information decoding program according to the first embodiment of the present invention produce the following effects.

That is, in the musical performance information compression apparatus and the like, by the process by the primary code production unit 2, wastes of the musical piece file 4 (SMF) are saved, and additionally the primary code 5 is produced as compressed data amount without impairing the musical performance information of the musical piece file 4 (SMF). Furthermore, in the primary code 5, the appearance frequency of the same data pattern is raised as compared with SMF, the same data pattern is recorded in a shorter distance, further the same code bytes are integrated in a closer position, and accordingly compression efficiency by the general-purpose compression system in the secondary code production unit 3 is enhanced.

This effect is similarly produced also by the primary code decoding unit 52, and secondary code decoding unit 51 in the musical performance information decoding apparatus or the like. Additionally, each musical performance information is set to be time-independent at the time of primary compressed, and the information relating to the order of the respective musical performance information is stored. Accordingly, when the encoded musical performance information is decoded, the order of the musical performance information does not change. That is, the decoded musical performance information completely matches the original musical performance information.

The first embodiment of the present invention have been described above, and in the musical performance information compression apparatus, method, and program of the present invention, the SMF or improved file is separated into at least information of relative time between events, information of sounding start pitch, information of loudness, information of sounding end pitch, and other information for each channel. Each information is integrated regardless of the above-described channel, the primary code is produced in which the above-described integrated information is disposed in independent regions, and the information of each region of the primary code is compressed by the general-purpose compression method. In the SMF, one track chunk includes one track data, the track data sometimes includes the data relating to a plurality of channels, but the data is integrated for each information regardless of the channel as described above, then the primary code preferable for the compression by the general-purpose compression method can be produced, and further it is possible to compress the data by the secondary code with high efficiency.

Furthermore, in the musical performance information compression apparatus, method, and program of the present invention, when a plurality of events relating to the same time are recorded in the same track data at the time of the primary code production, the information of the channel other than the event recorded in the end of the event group constituted of a plurality of events is recorded. When the information of the channel of the event recorded in the end is deleted in this manner, the data amount can be reduced.

Moreover, in the musical performance information compression apparatus, method, and program of the present invention, different event type identification codes are assigned to the respective events in accordance with high/low appearance frequency at the time of the primary code production, and the corresponding event type identification code is recorded for each event. An LHA coding method in which the LZ method is combined with the Huffman coding method is also usable at the time of the secondary code of the present invention. However, when the event type identification code is assigned in accordance with the high/low appearance frequency, the code is more preferable for a dynamic Huffman coding method, and, as a result, compression ratio can be lowered.

Moreover, in the musical performance information compression apparatus, method, and program of the present invention, the event type is identified based on the information of the relative time between the events at the time of the primary code production. Accordingly, for example, the event type can be identified based on the information of the Δtime, the data amount is reduced, and the compression efficiency at the time of the secondary code further rises.

Furthermore, in the musical performance information compression apparatus, method, and program of the present invention, a greatest common divisor of the relative time between the events is calculated at the time of the primary code, and the relative time between the events is coded by a numerical value obtained by division by the above-described greatest common divisor. The Δtime exists in a pair with each event, but even in a case where two bytes are usually required, one byte may be used, and the capacity can be entirely reduced. It is to be noted that it is supposed that the greatest common divisor is replaced with a predetermined value in a case where the divisor cannot be calculated.

Moreover, in the musical performance information decoding apparatus, method, and program of the present invention, the secondary code compressed by the above-described musical performance information compression apparatus or the like is decoded to obtain the primary code, further the primary code is decoded to obtain the musical piece file, and therefore effects similar to the above-described effects are produced.

It is to be noted that the present invention is not limited to the above-described embodiments, and can be variously improved/modified in a range without departing from the scope.

For example, in the above-described embodiment, the adoption of the LHA coding method or the like, which is a decoding system for the LZ coding method and the Huffman coding method, at the time of the secondary coding has been described as an example, but the present invention is not limited to this example, and various compression methods can be adopted. Examples of the method include a run length coding method, BSTW coding method, ZIP coding method and the like.

It is to be noted that as to the LZ coding method, in addition to an LZ77 coding method, there are variations such as an LZR coding method, LZSS coding method, LZB coding method, LZH coding method, LZBW coding method, LZIT coding method and the like.

Furthermore, the format of input data (musical piece file) is not limited to the format described in the beginning of the first embodiments, and, needless to say, the present invention is also applicable to the format of SMAF, MFi, or CMX.

Moreover, needless to say, the value of the maximum channel number MAX_CH in each flowchart is not limited to the above-described value.

Additionally, the musical performance information compression method, and the musical performance information decoding method specified by the respective operations of the musical performance information compression apparatus and the musical performance information decoding apparatus described above in the preferable embodiments and described later in claims are also included in the concept of the present invention.

The outline of the present invention and the preferable embodiments of the present invention have been described above, and a person skilled in a technical field associated with the present invention can create and execute the apparatus, method, system, program product, storage medium in which the program is stored, and other modifications in a range of the teaching of the present invention.

As described above in detail, according to the embodiments of the present invention, the order of the respective musical performance information is restored even after the decoding, a situation in which the decoded musical performance information does not match original musical performance information is prevented from being caused, and the reading of a part of the musical performance information is omitted to reduce the size of the primary code. Furthermore, there can be provided a musical performance information compression apparatus and a musical performance information decoding apparatus capable of efficiently compressing and expanding the data amount of the musical performance information by the combination with the general-purpose compression system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A musical performance information compression apparatus which receives an input of a file including an event constituted of at least information of a sounding start pitch, information of loudness, information of a sounding end pitch, and other information, and information of a relative time between the events, and having track data attributed to a predetermined channel and which compresses the file, the apparatus comprising:

primary code production section which separates track data of the file into a plurality of track data attributed to channels, holds information indicating attribution to the channel, further separates the track data attributed to each channel for each information, integrates the separated information by each type of the information regardless of the attribution to the channel, and disposes the information in an independent region for each type to produce a primary code; and secondary code production section which compresses each information disposed in each region of the primary code produced by the primary code production means by a predetermined compression method.

2. A musical performance information decoding apparatus which decodes a secondary code produced by compression of a file including an event constituted of at least information of a sounding start pitch, information of loudness, information of a sounding end pitch, and other information, and information of a relative time between the events, and having track data attributed to a predetermined channel into a primary code and which further decodes the primary code into the file, the apparatus comprising:

secondary code decoding section which decodes the secondary code into the primary code; and primary code decoding section which extracts each information of each type disposed in an independent region with respect to the primary code, refers to information indicating attribution to the channel, constitutes each extracted information as a plurality of track data attributed to each channel, and further constitutes the information as track data of the file to decode the primary code into the file.

* * * * *